US008107842B2

(12) United States Patent
Nakamura

(10) Patent No.: US 8,107,842 B2
(45) Date of Patent: Jan. 31, 2012

(54) IMAGE FORMING APPARATUS AND FIXING CONTROL METHOD

(75) Inventor: Akinobu Nakamura, Osaka (JP)

(73) Assignee: Ricoh Company, Ltd., Tokyo (JP)

( * ) Notice: Subject to any disclaimer, the term of this patent is extended or adjusted under 35 U.S.C. 154(b) by 735 days.

(21) Appl. No.: 12/206,993

(22) Filed: Sep. 9, 2008

(65) Prior Publication Data

US 2009/0067866 A1 Mar. 12, 2009

(30) Foreign Application Priority Data

Sep. 10, 2007 (JP) ..... 2007-233920
Mar. 18, 2008 (JP) ..... 2008-070253

(51) Int. Cl.
*G03G 15/20* (2006.01)

(52) U.S. Cl. ..... 399/67

(58) Field of Classification Search ..... 399/67, 399/70, 167, 122
See application file for complete search history.

(56) References Cited

U.S. PATENT DOCUMENTS 7,120,371 B2 * 10/2006 Fujimori ..... 399/67
7,949,272 B2 * 5/2011 Ozaki ..... 399/67
2005/0129421 A1 * 6/2005 Onishi ..... 399/38
2006/0088338 A1 * 4/2006 Matsuda et al. ..... 399/167
2006/0127144 A1 * 6/2006 Watanabe ..... 399/329

FOREIGN PATENT DOCUMENTS

JP 2004-264706 9/2004
JP 2004-333878 11/2004

* cited by examiner

*Primary Examiner* — David Gray
*Assistant Examiner* — Rodney Bonnette
(74) *Attorney, Agent, or Firm* — Oblon, Spivak, McClelland, Maier & Neustadt, L.L.P.

(57) ABSTRACT

A disclosed image forming apparatus includes a fixing unit configured to fix an unfixed image on a recording medium by bringing a first roller and a second roller in pressure-contact with each other; a contacting region detecting unit configured to detect a contacting region in which the first roller and the second roller are contacting each other, according to rotation of the first roller; a storing unit configured to store a contacting time in the contacting region detected by the contacting region detecting unit; and a rotation control unit configured to control the rotation of the first roller in such a manner as to change the contacting region in which the first roller and the second roller contact each other, based on the contacting time stored by the storing unit.

16 Claims, 15 Drawing Sheets

PRIOR ART

IMAGE FORMING APPARATUS AND FIXING CONTROL METHOD

BACKGROUND OF THE INVENTION

1. Field of the Invention

The present invention relates to an image forming apparatus such as a copier, a facsimile machine, and a printer including a fixing unit for heat-fixing an unfixed image (toner image) on a transfer sheet acting as a recording medium, and a fixing control method of the fixing unit.

2. Description of the Related Art

There are widely popular image forming apparatuses in which a toner image is transferred and carried on a recording medium such as a transfer sheet, and the toner image is heat-fixed onto the recording medium by dissolving the toner included in the toner image with a fixing unit (fixing device). In such a fixing unit using the heat-fixing method, there is a pair of rotating bodies, i.e., a fixing roller (heating roller) having a built in heating source such as a heater and a pressurizing roller, which face each other with their peripheral surfaces in contact. These rotating bodies are rotated and the recording medium is passed through the rotating bodies, so that heat and pressure are applied to fix the toner.

In a fixing unit using such a heat-fixing method, pressure and heat are applied to the pair of rotating bodies while they are maintained in contact, and therefore the rotating bodies may be damaged due to the heat and pressure. Accordingly, the peripheral surfaces of the rotating bodies may be damaged or deformed. Furthermore, when the rotation of the rotating bodies is stopped for a long time, in addition to the above-described damages, an elastic layer such as rubber provided on the pressurizing roller may become deformed.

FIGS. 15A and 15B schematically illustrate a deformed state of the rotating body of such a fixing unit 100, which shows side views in the axial direction of a fixing roller 110 and a pressurizing roller 120.

When the fixing unit 100 stops operating, and is abandoned for a long time, the rollers 110 and 120 also stop rotating, and are left for a long time in a state where the peripheral surfaces of the rollers 110 and 120 are in contact while being pressurized and heated (see FIG. 15A). Accordingly, an elastic layer 121 on the peripheral surface of the pressurizing roller 120 is locally pressurized. Therefore, a part of the elastic layer 121 is deformed, centering around a contact portion (nip portion) 122 where the elastic layer 121 contacts (pressure-contacts) the high-temperature fixing roller 110, and this deformed state is maintained for a while. Consequently, permanent compression deformation may occur on the elastic layer 121 at the contact portion 122.

Thus, in the conventional fixing unit 100, when the rollers start rotating once again (see FIG. 15B), even when the contact portion 122 is released from pressure, the deformed shape at this portion does not restore its original shape. In this manner, when the rollers are stopped for a long time, the pressurizing roller 120 tends to become deformed. Furthermore, in this fixing unit 100, depending on the configuration of the fixing roller 110, deformation such as plastic deformation may occur on the fixing roller 110 itself and on a resin layer formed on the surface of the fixing roller 110, due to heat and pressure. As described above, in the conventional technology, each of the rotating bodies of the fixing unit may become deformed and damaged, thereby shortening the operating life of the fixing unit and adversely affecting the heat-fixed image.

To address such problems, there is conventionally known an image forming apparatus having the following configuration. That is, when the fixing roller and the pressurizing roller are not rotating and are being preheated, at least one of the rollers is rotated at predetermined intervals for the purpose of preventing the same portions of the rollers from being in pressure-contact with one another for a long time. In this manner, the above described deformation is mitigated while the rollers are being preheated (see patent document 1).

However, when the rollers are not being preheated, i.e., when this conventional image forming apparatus is operating under regular circumstances or during an energy saving mode, the rollers are maintained in contact with each other. Thus, after being in contact for a long time, the surfaces of the rollers may be deformed or damaged. Furthermore, there may be unevenness in the contacting position while the rollers are not rotating (the rollers may always contact each other at the same particular position). Thus, the damage caused by heat and pressure will not be evenly distributed across the rollers, but will be concentrated in the particular position. As a result, the rotating bodies may be partially damaged. Accordingly, this conventional image forming apparatus is not sufficiently effective in increasing the operating life of the fixing unit, and damages may occur within a short period of time.

There is another conventionally known information forming apparatus having the following configuration. Specifically, when the fixing unit is not operating, a pressure releasing member is inserted between the pair of rotating bodies to separate the rotating bodies from one another. Thus, the rotating bodies are prevented from being in contact for a long period of time so as to prevent the surfaces of the rotating bodies in contact with each other from becoming deformed (see patent document 2).

However, in this conventional image forming apparatus, it is necessary to additionally provide a relatively large member to be inserted between the rotating bodies, a mechanism for driving this member, and a mechanism for separating the rotating bodies. This increases the manufacturing cost as well as the size of the fixing unit and the image forming apparatus.

Patent Document 1: Japanese Laid-Open Patent Application No. 2004-333878

Patent Document 2: Japanese Laid-Open Patent Application No. 2004-264706

SUMMARY OF THE INVENTION

The present invention provides an image forming apparatus and a fixing control method in which one or more of the above-described disadvantages are eliminated.

A preferred embodiment of the present invention provides an image forming apparatus and a fixing control method, in which a pair of rotating bodies in a fixing unit for heat-fixing an unfixed image is prevented from being deformed or damaged, and the operating life of the fixing unit is increased.

According to an aspect of the present invention, there is provided an image forming apparatus including a fixing unit configured to fix an unfixed image on a recording medium by bringing a first roller and a second roller in pressure-contact with each other; a contacting region detecting unit configured to detect a contacting region in which the first roller and the second roller are contacting each other, according to rotation of the first roller; a storing unit configured to store a contacting time in the contacting region detected by the contacting region detecting unit; and a rotation control unit configured to control the rotation of the first roller in such a manner as to change the contacting region in which the first roller and the second roller contact each other, based on the contacting time stored by the storing unit.

According to one embodiment of the present invention, an image forming apparatus and a fixing control method are provided, in which a pair of rotating bodies in a fixing unit for heat-fixing an unfixed image is prevented from being deformed or damaged, and the operating life of the fixing unit is increased.

BRIEF DESCRIPTION OF THE DRAWINGS

Other objects, features and advantages of the present invention will become more apparent from the following detailed description when read in conjunction with the accompanying drawings, in which.

DETAILED DESCRIPTION OF THE PREFERRED EMBODIMENTS

A description is given, with reference, to the accompanying drawings, of an embodiment of the present invention.

An image forming apparatus according to an embodiment of the present invention is provided with a fixing unit including a pair of rotating bodies that are rotatable while being in contact with one another and a driving unit for rotating these rotating bodies. Furthermore, this fixing unit is a fixing device employing the heat-fixing method. Specifically, a sheet-type recording medium such as a recording sheet or a resin film used for OHPs (Over Head Projectors) is passed through a nip portion formed in between the rotating bodies, so that pressure and heat are applied to the recording medium through the rotating bodies. Accordingly, an unfixed image such as a toner image being carried on the recording medium can be heat-fixed onto the recording medium.

Furthermore, the present embodiment takes as an example a fixing unit of a tandem-type image forming apparatus in which toners of plural colors are used to form a color image on a recording sheet by an electrophotographic method. Furthermore, the following takes as an example a fixing unit in which the pair of rotating bodies in the fixing unit includes a fixing roller (heating roller, first roller) and a pressurizing roller (second roller) which are in contact (pressure-contact) with their peripheral surfaces pressed against one another. The rollers rotate in a direction opposite to the direction in which the sheet is being conveyed so that the sheet is passed through these rollers. While the sheet is passing through the rollers, the unfixed image (toner image in this example) on the recording sheet is heated and dissolved while receiving pressure, so as to be fixed on the recording sheet.

Figure 1:
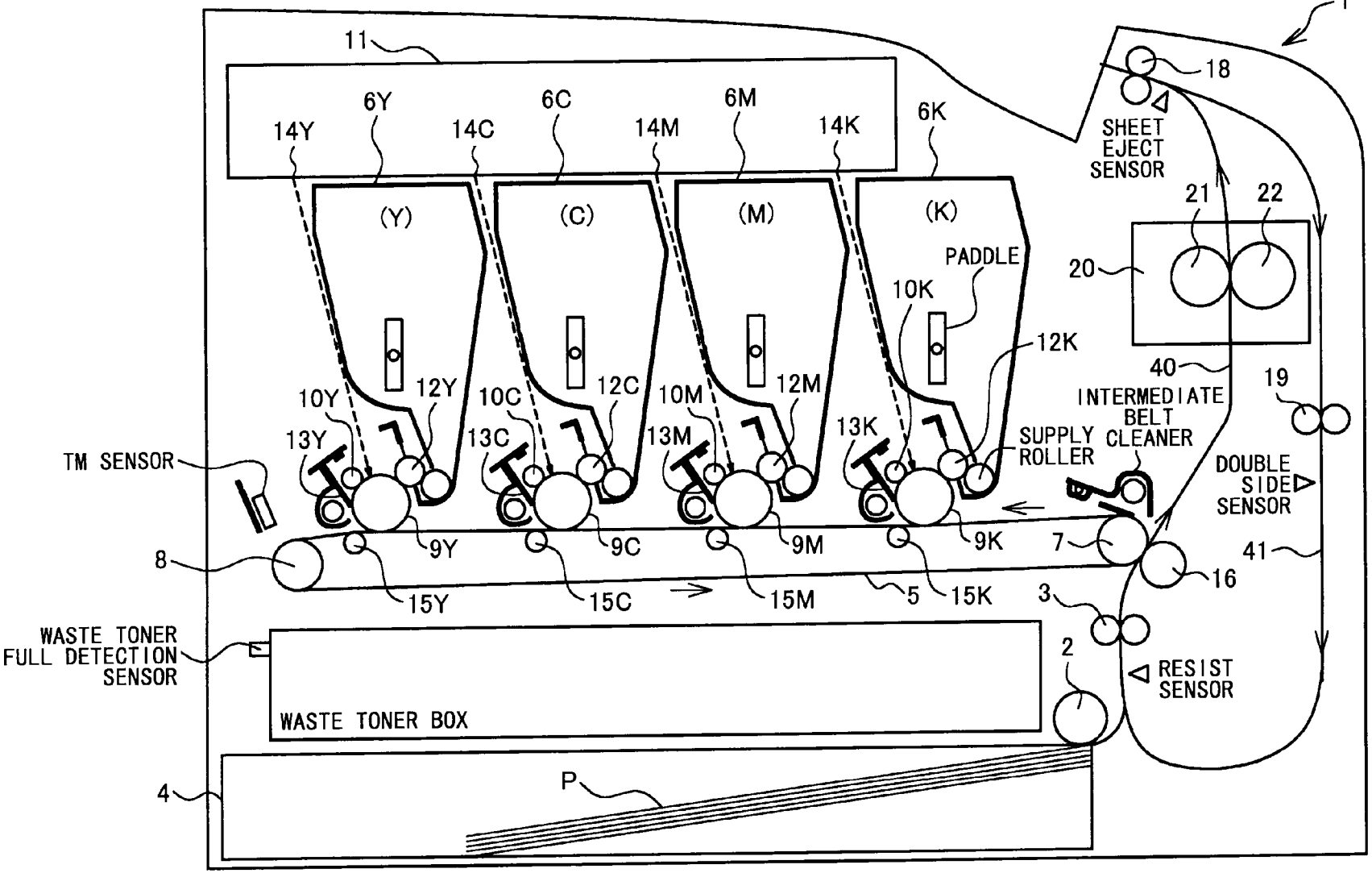
FIG. 1 is a schematic diagram of an image forming apparatus according to an embodiment of the present invention.

FIG. 1 is a configuration diagram of the image forming apparatus according to the present embodiment, in which relevant parts are schematically illustrated.

As shown in FIG. 1, an image forming apparatus 1 includes a sheet feeding tray 4 that can accommodate plural recording sheets P, a transfer belt 5 disposed above the sheet feeding tray 4, plural cartridges (electrophotographic processing units) 6K, 6M, 6C, and 6Y disposed along the transfer belt 5, an exposing unit 11 disposed above the cartridges 6K, 6M, 6C, and 6Y, and a fixing unit 20 provided in a conveying path 40 through which the recording sheet P is conveyed. In this example, the color components are black (B), magenta (M), cyan (C), and yellow (Y), and therefore the cartridges 6K, 6M, 6C, and 6Y are provided for the four colors, so that a toner image of each of the four colors is generated by an electrophotographic process.

The recording sheets P accommodated in the sheet feeding tray 4 are stacked on top of each other. At the time of image formation, a sheet feeding operation is performed by rotating a sheet feeding roller 2 in a predetermined direction (counterclockwise as viewed in FIG. 1) to send out the recording sheets P toward the conveying path 40, starting with the top sheet. Furthermore, the recording sheet P that has been sent out is conveyed along the conveying path 40 by plural rollers 3, 7, 16, 21, 22, and 18, and is ejected outside the apparatus.

The transfer belt 5 is an endless belt acting as an intermediate transfer body, onto which toner images are transferred from the cartridges 6K, 6M, 6C, and 6Y, which toner images are then transferred onto the recording sheet. The transfer belt 5 is wound around a rotatable secondary transfer driving roller 7 and a transfer belt tension roller 8. Among these rollers 7 and 8, the secondary transfer driving roller 7 is rotated by a driving source (not shown) such as a motor. The transfer belt tension roller 8 is rotated following the rotation of the secondary transfer driving roller 7. The rotatable secondary transfer driving roller 7 and the transfer belt tension roller 8 support the transfer belt 5 in such a manner that it extends in a substantially horizontal direction with respect to the vertical direction. Accordingly, the rotatable secondary transfer driving roller 7, the transfer belt tension roller 8, and the driving source configure a driving unit for rotating the transfer belt 5, so that the transfer belt 5 is circulated in a predetermined direction (counterclockwise as indicated by arrows in FIG. 1) between the rotatable secondary transfer driving roller 7 and the transfer belt tension roller 8.

The cartridges 6K, 6M, 6C, and 6Y are disposed above the transfer belt 5 at predetermined intervals from the upstream direction along the rotating direction of the transfer belt 5. As described below, each of these cartridges 6K, 6M, 6C, and 6Y is an AIO (all in one) cartridge, in which a photoconductive unit including a photoconductive drum, a toner filling unit filled with toner, a developing device, and a cleaning system are integrated as a single unit. The cartridges 6K, 6M, 6C, and 6Y contain toners of different colors corresponding to the colors of the images to be formed. Furthermore, the first cartridge 6K for forming black (K) images, the second cartridge 6M for forming magenta (M) images, the third cartridge 6C for forming cyan (C) images, and the fourth cartridge 6Y for forming yellow (Y) images are aligned along the transfer belt starting from the upstream side of the transfer belt 5.

The exposing unit 11 is for radiating laser beams 14K, 14M, 14C, and 14Y (indicated by dotted lines in FIG. 1), which are exposure light beams corresponding to the colors of the images to be formed by the cartridges 6K, 6M, 6C, and 6Y, onto predetermined positions in the cartridges 6K, 6M, 6C, and 6Y, respectively. Accordingly, the exposing unit 11 is provided with plural (four in this example) light sources (not shown) for generating the laser beams 14K, 14M, 14C, and 14Y. These laser beams are radiated from the bottom surface of the exposing unit 11 in a downward direction, so that photoconductive drums 9K, 9M, 9C, and 9Y of the cartridges 6K, 6M, 6C, and 6Y are exposed to the laser beams.

Next, a description is given of the cartridges 6K, 6M, 6C, and 6Y. These cartridges have the same internal configuration, except that they form toner images of different colors. Therefore, the first cartridge 6K (black image forming unit) positioned on the most upstream side (on the far right side as viewed in FIG. 1) in the rotational direction of the transfer belt 5 is taken as an example, and the cartridges 6M, 6C, and 6Y for forming images of other colors are not further described. The elements common to the cartridges 6K, 6M, 6C, and 6Y are denoted by the same reference numerals accompanied by different alphabetical letters K, M, C, and Y representing the colors of the images to be formed by the cartridges 6K, 6M, 6C, and 6Y, respectively.

The first cartridge 6K (image forming unit) includes the photoconductor 9K which is a photoconductive drum provided in such a manner as to face the upper surface of the transfer belt 5, and a charger 10K, a developer 12K, and a cleaner blade (photoconductor cleaner) 13K that are disposed around the photoconductor 9K.

When image formation is performed, the peripheral surface of the photoconductor 9K is uniformly charged by the charger 10K in the dark, and is then exposed to the laser beam 14K corresponding to a black image radiated from the exposing unit 11, so that an electrostatic latent image is formed on the peripheral surface (photoconductive surface). The exposing unit 11 controls the light emission of the light source for the laser beam 14K in accordance with line image signals in the main scanning direction, so that the generated light is radiated at predetermined periods on the photoconductive surface of the photoconductor 9K as scanning beams. At the same time, the photoconductor 9K is moved (rotated) in the sub scanning direction intersecting the main scanning direction (the movement in the sub scanning direction is controlled by controlling a motor (not shown) for rotating the photoconductor 9K). Accordingly, scanning exposure for forming a two dimensional image is performed with the scanning beam.

The developer 12K develops the electrostatic latent image on the photoconductor 9K to turn it into a visible image with the use of black toner, thereby forming a black toner image on the photoconductor 9K. Then, the toner image is transferred onto the transfer belt 5 by the operation of a primary transfer roller 15K disposed in such a manner as to face the photoconductor 9K across the transfer belt 5, at a position (primarily transfer position) at which the photoconductor 9K and the transfer belt 5 contact each other. Accordingly, a monochrome image is formed on the transfer belt 5 with black toner. Meanwhile, the photoconductor 9K that has finished transferring the toner image is cleaned by having the cleaner blade 13K wipe off any unnecessary toner remaining on the peripheral surface of the photoconductor 9K, to be prepared for the next image forming operation.

By the above processes, the black toner image is transferred onto the transfer belt 5 by the first cartridge 6K. This transfer belt 5 is rotated according to the rotation of the secondary transfer driving roller 7. Accordingly, the part (surface) on which the toner image has been formed is moved to the second cartridge 6M which is the next one positioned on the downstream side in the rotational direction, so that the toner image is conveyed to the position beneath the second cartridge 6M. At the second cartridge 6M, the same image forming process as that performed by the first cartridge 6K is performed to form a magenta toner image on the photoconductor 9M. This magenta toner image is transferred so as to be superposed on the black toner image formed on the transfer belt 5.

Next, the transfer belt 5 moves to the third cartridge 6C and the fourth cartridge 6Y in this order, which are positioned further downstream, and the same processes and operations as described above are performed, so that a cyan toner image formed on the photoconductor 9C and a yellow toner image formed on the photoconductor 9Y are sequentially transferred in such a manner as to be superposed on the toner image on the transfer belt 5. Accordingly, plural toner images of different colors are transferred onto the transfer belt 5 in such a manner as to be superposed on one another, thereby forming a full color superposed image (color image). Subsequently, as the transfer belt 5 rotates, the portion of the transfer belt 5 on which the color toner image is formed moves to the position of the secondary transfer roller 16.

When only a black image is to be formed in the image forming operation, the second to fourth cartridges 6M, 6C, and 6Y do not operate. The corresponding primary transfer rollers 15M, 15C, and 15Y are retreated to positions away from the photoconductors 9M, 9C, and 9Y, respectively. Only the first cartridge 6K executes the process for forming a black image.

Meanwhile, in synchronization with the movement (rotation) of the transfer belt 5, the operation of conveying the recording sheet P along the conveying path 40 is also started. First, the recording sheets P accommodated in the sheet feeding tray 4 are sequentially sent out starting with the top sheet by the rotation of the sheet feeding roller 2. Then, the recording sheet P waits at the position of the resist rollers 3, immediately before the secondary transfer roller 16 (upstream side in the conveyance direction). These resist rollers 3 start rotating at a timing such that the toner image conveyed by the movement of the transfer belt and the position of the recording sheet P overlap each other at the secondary transfer roller 16 (between the secondary transfer driving roller 7 facing the secondary transfer roller 16). The resist rollers 3 are rotated in a counterclockwise direction by a driving unit (not shown), to send out the recording sheet.

The toner image on the transfer belt 5 is transferred, by the secondary transfer roller 16, onto the recording sheet P that has been sent out by the resist rollers 3. The recording sheet P is conveyed toward the downstream side of the conveying path 40 while being moved for this secondary transfer operation. Subsequently, the recording sheet P passes through a nip portion formed between the fixing roller 21 (first roller) and the pressurizing roller 22 (second roller) which are a pair of rotating bodies included in the fixing unit 20, where heat and pressure are applied to the recording sheet P. Accordingly, the toner image is heat-fixed by heat and pressure. Then, the recording sheet P is ejected outside the image forming apparatus 1 (to the top in this example) by the sheet eject rollers 18 being rotated in a predetermined direction (clockwise direction in this example) by a driving unit (not shown).

In a case of performing double-sided printing on the recording sheet P, the sheet eject rollers 18 are rotated in the opposite direction (counterclockwise direction in this example) immediately before the recording sheet P passes through the sheet eject rollers 18, to send the recording sheet P to a double-sided conveying path 41. In the double-sided conveying path 41, the recording sheet P passes through rotating double side rollers 19, and is once again conveyed to the resist rollers 3. The recording sheet P that has reached the resist rollers 3 is once again conveyed along the conveying path 40 by the resist rollers 3. This time, a toner image is transferred from the transfer belt 5 by the secondary transfer roller 16 onto the side opposite to that on which an image has already been formed. Then, the new toner image is heat-fixed on the recording sheet P by the fixing unit 20 in the same manner as above. Finally, the recording sheet P is ejected outside the image forming apparatus 1 by the sheet eject rollers 18.

Next, a more detailed description is given of the fixing unit 20 of the image forming apparatus 1.

Figure 2:
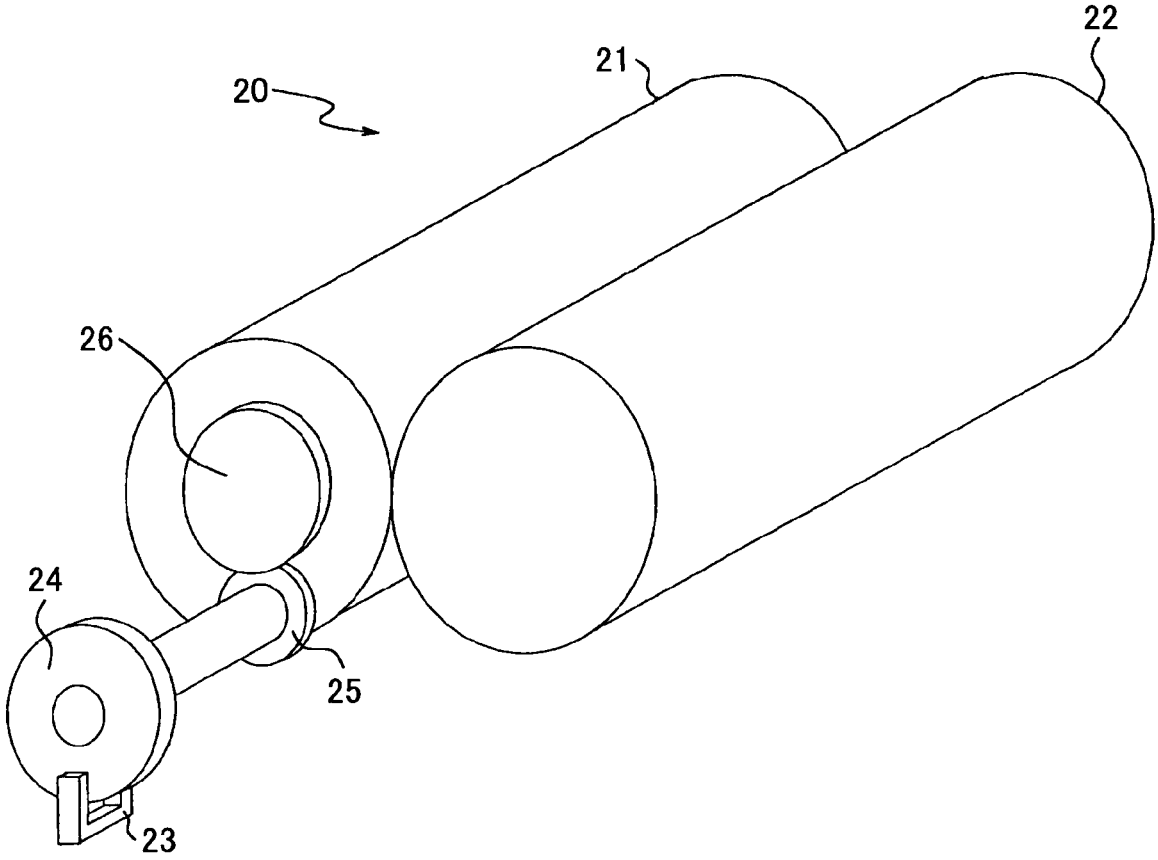
FIG. 2 is a perspective view of a schematic configuration of a fixing unit in the image forming apparatus according to an embodiment of the present invention.

FIG. 2 is a perspective view of the schematic configuration of the fixing unit 20.

As shown in FIG. 2, the fixing unit 20 includes a pair of rotating bodies (hereinafter, also referred to as "two rollers") configured with the fixing roller 21 and the pressurizing roller 22, having their peripheral surfaces contacting each other. The two rollers are rotatably supported with their axis lines being substantially parallel to one another. The two rollers have cylindrical shapes having substantially the same diameters. Either one of the two rollers (in this example, the fixing roller 21) is provided with a driving unit. When the fixing roller 21 is rotated on its axis line by the driving unit, the pressurizing roller 22, which is in contact with the fixing roller 21, is also caused to rotate on its axis line.

The driving unit includes a motor (not shown) and a gear train for transmitting the rotation of the motor to the fixing roller 21, which gear train is configured with a gear (1) 24, a gear (2) 25, and a gear (3) 26. The gear (1) 24 includes a photosensor 23 for detecting the rotation. The rotation detecting signals of the photosensor 23 are used for detecting the contacting region of the fixing roller 21 and the pressurizing roller 22 (the operation of detecting the contacting region is described below in detail).

The fixing roller 21 is, for example, made of metal. A heating source (not shown) such as a heater is disposed adjacent to the outside of the fixing roller 21 or built into the hollow space inside the fixing roller 21 (in this case, a built-in heater is provided). Accordingly, the fixing roller 21 serves as a heating unit in the fixing unit 20 for heating the recording sheet P to a predetermined temperature at which the toner can be dissolved. Meanwhile, the pressurizing roller 22 is provided with an elastic layer (not shown) made of, for example, rubber, on its peripheral surface, and is also biased (pressurized) toward the fixing roller 21 with predetermined pressure by a biasing unit (not shown). As the elastic layer deforms, a nip portion having a predetermined width is formed between the peripheral surfaces of the two rollers.

In the fixing unit 20, the driving unit rotates the two rollers 21 and 22 in a direction opposite to that of the recording sheet P while the two rollers 21 and 22 are pressed against each other, thereby making the recording sheet P pass through the nip portion between the two rollers 21 and 22. While the recording sheet P is being conveyed, the toner image is fixed onto the recording sheet P by applying heat and pressure with heat primarily exerted from the fixing roller 21 and pressure primarily exerted from the pressurizing roller 22. Accordingly, the pressurizing roller 22 serves as a pressurizing unit in the fixing unit 20 for applying pressure to the recording sheet P.

The operation of the fixing unit 20 is controlled in accordance with the image forming operation. In this type of image forming apparatus, in a regular control operation, unless there is another image forming instruction when the printing operation ends, the main power (power switch for operating the apparatus) is turned off, and the fixing unit 20 stops operating. Thus, the two rollers that have been operating are also stopped, and power supplied to the heating source of the fixing unit 20 is either stopped or controlled (power may be supplied in an energy saving mode).

When the two rollers are stopped (not operating), and the two rollers are pressed against each other for a while, the two rollers may be damaged or deformed, as described above in the background of the invention.

To mitigate such damages and deformation, the image forming apparatus 1 according to the present embodiment has the following configuration. That is, the position at which the peripheral surfaces of the two rollers contact each other (contacting position) when the two rollers are stopped, is distributed (so that the rollers do not always contact each other at the same position). Accordingly, it is possible to prevent unevenness in the contacting positions, which leads to damages and deformation. The contacting position is distributed by managing the history of the contacting positions while the two rollers are stopped, and stopping the two rollers at positions that are determined based on the managed history information, in such a manner that there is no unevenness in the contacting positions.

Specifically, the operation of stopping the two rollers is controlled in the following manner (stop control operation). That is, the history information of the contacting positions while the two rollers are stopped is obtained as follows. That is, the peripheral surface where the two rollers contact each other is divided into predetermined regions. The accumulated value of the contacting time in each region is obtained. The obtained accumulated contacting time for each region is managed. Based on the managed contacting time in each region, the region where the contacting position is to be located (contacting region) is determined. The two rollers are stopped such that the contacting position is located in the determined region.

Figure 3:
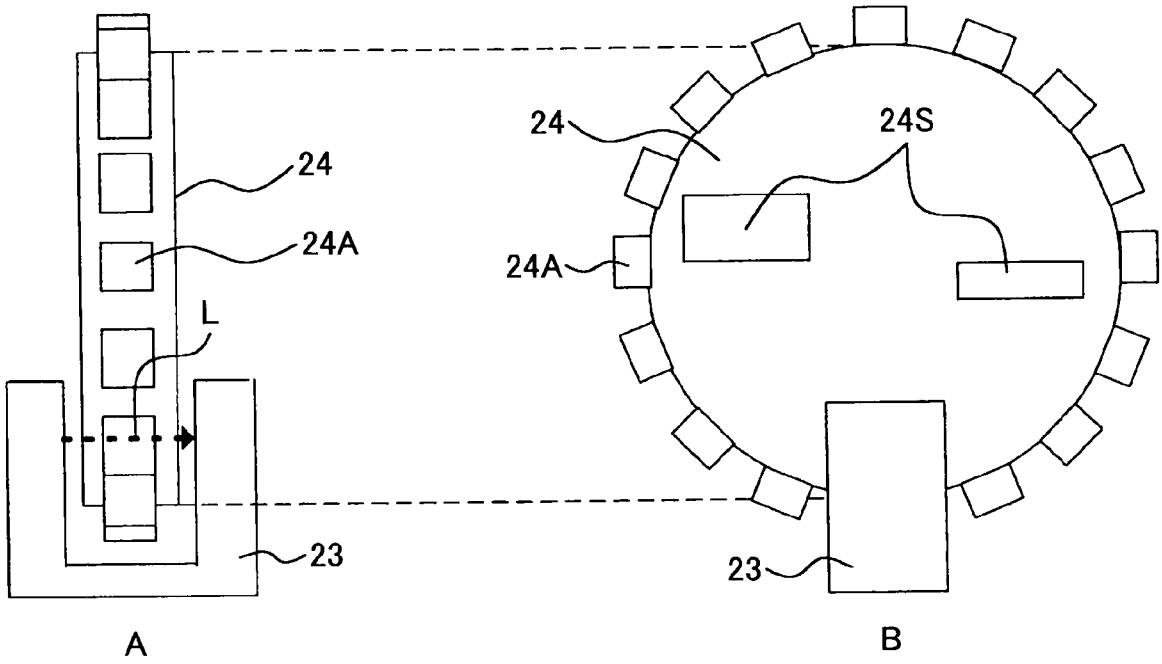
FIG. 3 illustrates a configuration of a rotational sensor provided on a gear for driving a fixing roller.
Figure 4:
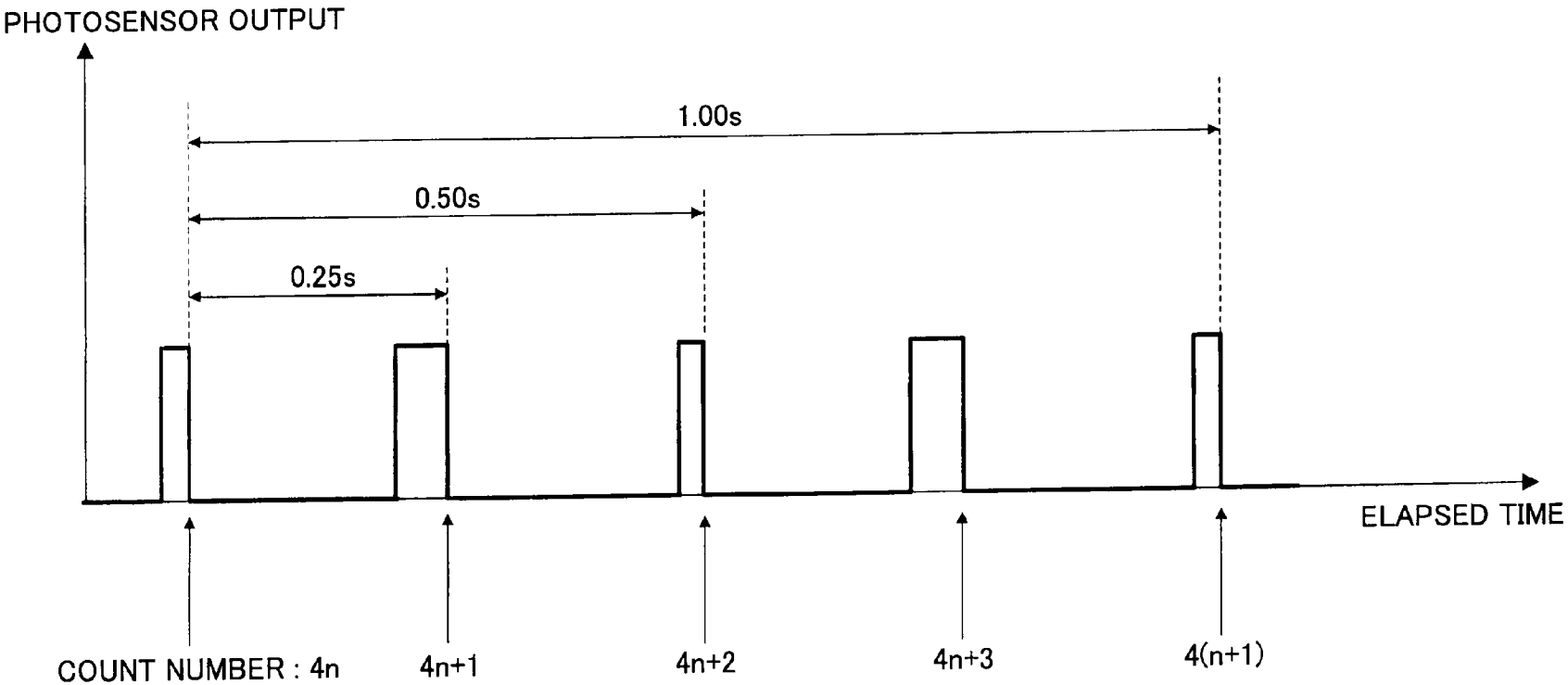
FIG. 4 is a time chart illustrating the output of a photosensor when the fixing roller is being driven.

A description is given of a unit for detecting the contacting region of the two rollers, which is an element necessary for controlling operations of the fixing unit 20. With reference to FIGS. 3 and 4, a description is given of the photosensor 23 provided as the detecting unit on the fixing roller 21.

FIG. 3 illustrates a configuration of the photosensor 23 provided on the gear for driving the fixing roller 21. In FIG. 3, (B) is a front view, i.e., a view in the axis line direction of the gear (1) 24, and (A) is a side view.

The photosensor 23 according to the present embodiment is a transmissive sensor, in which a light-emitting element is facing a light-receiving element such that a detection light L emitted from the light-emitting element enters the light-receiving element. As shown in FIG. 3, the photosensor 23 is positioned such that the detection light is blocked by the gear (1) 24. However, there are slits 24S provided in the gear (1)

24, through which the detection light can be transmitted to enter the light-receiving element and comb-teeth 24A provided around the periphery of the gear (1) 24.

By providing the slits 24S at predetermined positions in the rotational direction of the gear (1) 24, the output of the light-receiving element changes as the detection light L is blocked and transmitted while the gear (1) 24 is rotating. It can be detected that the gear (1) 24 is rotating due to this change in the output of the photosensor 23.

In the example shown in FIG. 2, the speed of the gear (1) 24 on the input side of the gear train driving the fixing roller 21 is 120 rpm, and the gear (3) 26 has a lower speed at 60 rpm. That is, the gear ratio is set such that every time the fixing roller 21 rotates once, the gear (1) 24 rotates twice.

FIG. 4 is a time chart illustrating the output of the photosensor when the fixing roller is being driven. The output shown in FIG. 4 is the output of the photosensor 23 while the fixing roller 21 rotates once.

The gear (1) 24 has two slits 24S of different sizes positioned at 180 degrees from one another in the rotational direction. When the slits 24S pass through the photosensor 23, the output of the photosensor 23 increases, such that the output becomes a rectangular wave as shown in FIG. 4. The gear (1) 24 rotates at a constant speed of 120 rpm. Therefore, in a rotational period of 0.5 seconds, the rectangular wave falls at intervals of 0.25 seconds.

The fixing roller 21 rotates once every time the gear (1) 24 rotates twice, and therefore a rectangular wave rises four times every time the fixing roller 21 rotates once. The rectangular waves are counted every time they rise. Therefore, four different regions of the fixing roller 21 can be recognized, i.e., a region 1 is recognized when the count number is 4n, a region 2 is recognized when the count number is 4n+1, a region 3 is recognized when the count number is 4n+2, and a region 4 is recognized when the count number is 4n+3.

The sizes of the slits 24S are different, and therefore the times of the changed outputs of the photosensor 23 are different. When the slit having the larger width passes, the count number is 4n+1 or 4n+3, and when the slit having the smaller width passes, the count number is 4n or 4n+2. In order to uniquely associate each region with one of the four rectangular waves, the home position of the fixing roller 21 needs to be determined so that the relationship between the four rectangular waves and the regions can be fixed.

FIGS. 3 and 4 illustrate an example of a transmissive sensor; however the same configuration can be realized with a reflective sensor. In the case of a reflective sensor, for example, light reflected from the comb-tooth part 24A of the gear for driving the fixing roller is made to enter a light-receiving element to obtain sensor outputs in synchronization with the rotation.

In the sensor output, a rectangular wave is formed for each comb-tooth (protrusion) 24A of the gear. Therefore, in order to recognize contacting regions in the same manner as above, the number of comb-teeth 24A and the number of the regions are to be the same. By counting the number of rectangular waves formed for sensor outputs corresponding to comb-teeth 24A, the contacting region can be detected. In this method also, in order to uniquely associate each region of the fixing roller 21 with a region detected with the number of rectangular waves corresponding to the number of comb-teeth 24A, the home position of the fixing roller 21 needs to be determined, so that the relationship between the regions detected with the number of rectangular waves corresponding to the number of comb-teeth 24A and the regions can be fixed.

Next, a description is given of a control system that performs the stop control operation. This control system determines the region in which the contacting position is to be located when the two rollers stop operating, based on the accumulated contacting time in each region obtained by accumulating the contacting time in each of the separate regions on the peripheral surface of the fixing roller 21. The control system then stops the two rollers in such a manner that the contacting position is located in the determined region.

Figure 5:
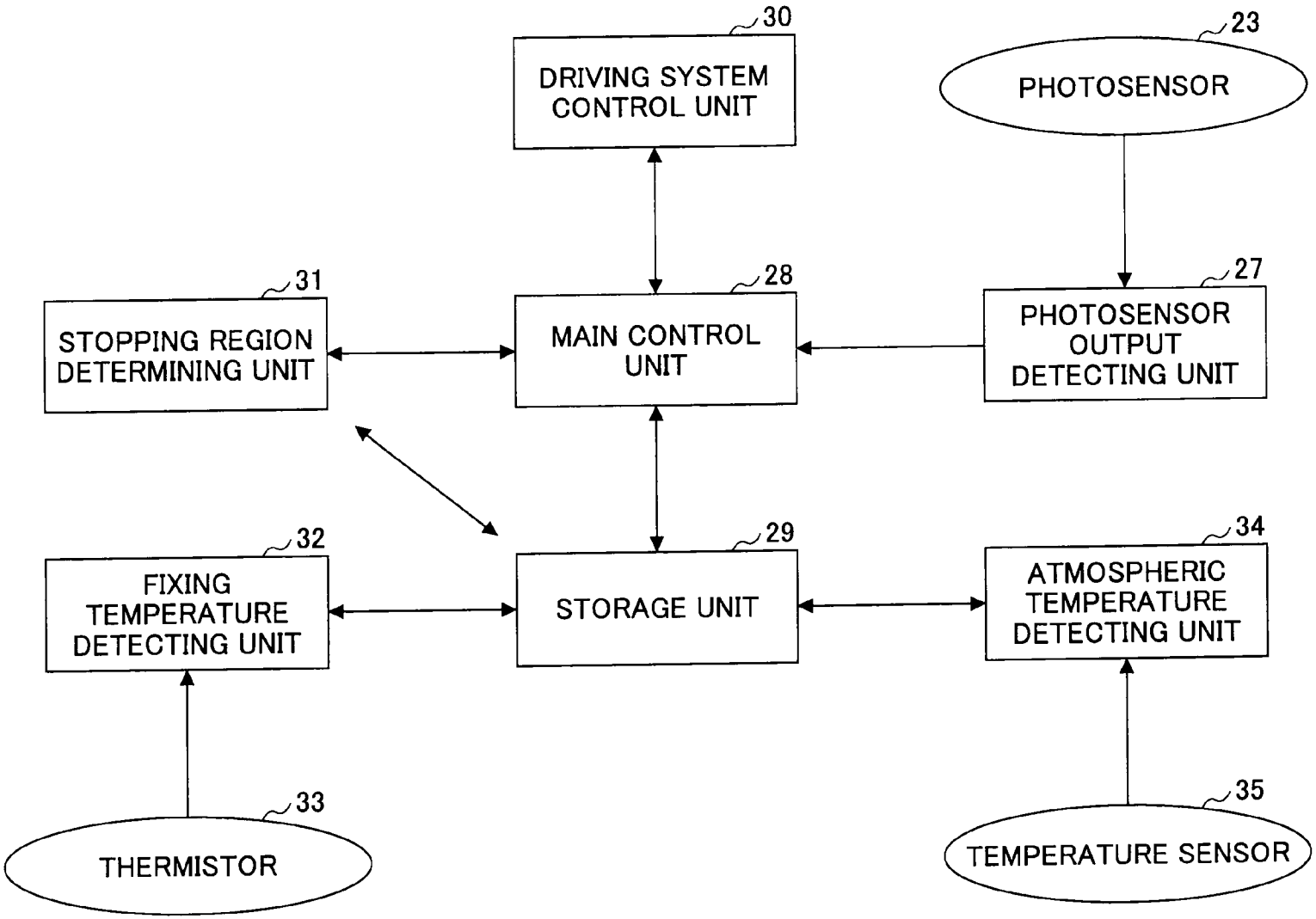
FIG. 5 is a schematic block diagram of a control system included in the image forming apparatus according to an embodiment of the present invention.

FIG. 5 is a schematic block diagram of the control system included in the image forming apparatus 1. Various functional units in this control system (excluding various sensors) can be configured with a microcomputer built in the image forming apparatus 1 including a central processing unit (CPU) and various memories such as a ROM and a RAM.

As shown in FIG. 5, the image forming apparatus 1 includes a main control unit 28 for controlling all units of the image forming apparatus 1, a storage unit 29, a driving system control unit 30, and a stopping region determining unit 31 connected to the main control unit 28, a thermistor 33 connected to the storage unit 29 via a fixing temperature detecting unit 32 acting as an interface, and a temperature sensor 35 connected to the storage unit 29 via an atmospheric temperature detecting unit 34 acting as an interface. Furthermore, the photosensor 23 is connected to the main control unit 28 via a photosensor output detecting unit 27 acting as an interface. The image forming apparatus 1 operates these units in accordance with a predetermined program and timings that have been set beforehand to execute the processing procedures and the control flow described below.

The control system shown in FIG. 5 is common to all embodiments. However, detection performed by the fixing temperature detecting unit 32 and the atmospheric temperature detecting unit 34 is not necessary in an "operation for changing contacting region when fixing roller is stopped" described below, which is the basic operation of the stop control operation to accumulate the contacting time on the fixing roller 21 and to control the two rollers to stop at the determined region. In this case, the operation can be performed without the unnecessary elements.

First, a description is given of operations for detecting the contacting region of the two rollers and accumulating the contacting time in each contacting region. In the following description, the photosensor 23 shown in FIG. 3 is taken as an example of a transmissive sensor.

The output of the photosensor 23 is amplified at the photosensor output detecting unit 27. The photosensor output detecting unit 27 includes an operational amplifier. When the output of the photosensor 23 is more than or equal to a reference value, it is determined that the light from the light-emitting element that has passed through the slit 24S of the gear (1) 24 is received, and the photosensor output detecting unit 27 amplifies the output and sends the output to the main control unit 28.

The main control unit 28 that receives the sensor output signals performs a logical operation by using, as inputs, the sensor output signals of rectangular waves having different widths and the signal of a home position. Accordingly, as described above, the count numbers 4n, 4n+1, 4n+2, and 4n+3 corresponding to the four separate regions can be obtained, and the obtained count numbers are stored in the storage unit 29. These count numbers correspond to the four separate regions, and therefore it is possible to recognize the contacting region of the two rollers based on the count number obtained as a detected value when the two rollers are stopped.

The operation of recognizing the contacting region is to be constantly performed by the main control unit 28 while controlling the fixing unit 20. The count number obtained as a result of the recognition is stored and managed by the storage unit 29.

The history information, which is managed to be used for the stop control operation for the two rollers in the fixing unit 20, corresponds to the accumulated contacting time in each region when the two rollers are stopped.

Accordingly, the main control unit 28 reads the count number managed by the storage unit 29 obtained by an operation of recognizing the contacting region when the two rollers are stopped, and based on the read count number, the main control unit 28 obtains the region in which the two rollers are presently contacting each other, and identifies the contacting region when the two rollers are stopped.

The contacting time while the two rollers are stopped is obtained by measuring the time from when the two rollers are stopped until the two rollers start rotating again. For example, the time obtained by reading a clock when the two rollers are stopped is stored. Then, calculation is performed based on the time obtained by reading a clock when the two rollers start rotating again and the stored time, thereby obtaining the contacting time in the identified contacting region.

However, when it is necessary to obtain an accumulated value of the contacting time in a real time manner while the two rollers are stopped ("operation for changing contacting region when fixing roller is stopped" described below), a method of performing the accumulating operation at predetermined intervals is employed.

The contacting times are managed for each region as history of contacting times when the two rollers are stopped. Accordingly, the obtained contacting time is added to the contacting time already being managed as history of the corresponding contacting region. Thus, the history information of the contacting time is revised according to the obtained time, and the revised history information is managed by the storage unit 29. The operations of detecting and managing the contacting times are described below with reference to FIG. 7.

The driving system control unit 30 of the control system (FIG. 5) is a rotation control unit for controlling the rotation of at least one of the two rollers, i.e., the fixing roller 21 and the pressurizing roller 22, in response to an instruction from the main control unit 28. In this example, a driving unit such as a motor (not shown) of the fixing unit 20 is controlled to rotate the two rollers at a predetermined speed, and to stop the two rollers in a state where they are contacting each other in a particular region on their peripheral surfaces (the stop control operation is described below in detail).

In response to an instruction from the main control unit 28, the stopping region determining unit 31 determines beforehand a stopping region in which the two rollers are to contact each other when they stop rotating, based on the contacting time of each region that is stored and managed by the storage unit 29. The stopping region determining unit 31 also functions as a comparing unit for comparing the contacting times. This comparing unit compares the stored contacting times of plural regions, determines which contacting time is the shortest, and determines that the region having the shortest contacting time among the plural regions is to be the stopping region, in which the two rollers are to contact each other when they are stopped.

The stopping region determining unit 31 sends this determination result, via the main control unit 28, to the driving system control unit 30 which is the rotation control unit of the two rollers. The driving system control unit 30 that has received the determination result executes the operation of stopping the two rollers. That is, based on the determination made by the stopping region determining unit 31, the driving system control unit 30 controls the driving unit of the two rollers so that the rotating two rollers stop in a state where they are contacting each other in the determined stopping region. Accordingly, the two rollers stop rotating and wait in the stopped state until the next operation.

Furthermore, in the present embodiment, even while the rotation of the two rollers is stopped, the comparing unit of the stopping region determining unit 31 compares the contacting times of the regions and controls the rotation of the two rollers based on the comparison results. Specifically, the accumulating unit sequentially adds the contacting time of the two rollers while they are stopped, to the contacting time of the corresponding region. Then, based on comparison results, when the accumulated contacting time of the region in which the two rollers are presently contacting each other is no longer the shortest contacting time, or when a predetermined relationship is established, the stopping region determining unit 31 determines a new stopping region for the two rollers to change the stopping region. Based on this determination, the driving system control unit 30 (rotation control unit) controls the driving unit to once again start rotating the two rollers that have been stopped, and then stop rotating the two rollers so that they contact each other in the new stopping region determined as above.

"Basic Operation of Stop Control Operation"

Next, a description is given of the basic operation of the stop control operation for the two rollers, i.e., the fixing roller 21 and the pressurizing roller 22, which is performed by the above-described control system (FIG. 5), with the use of the contacting time managed as history information.

Figure 6:
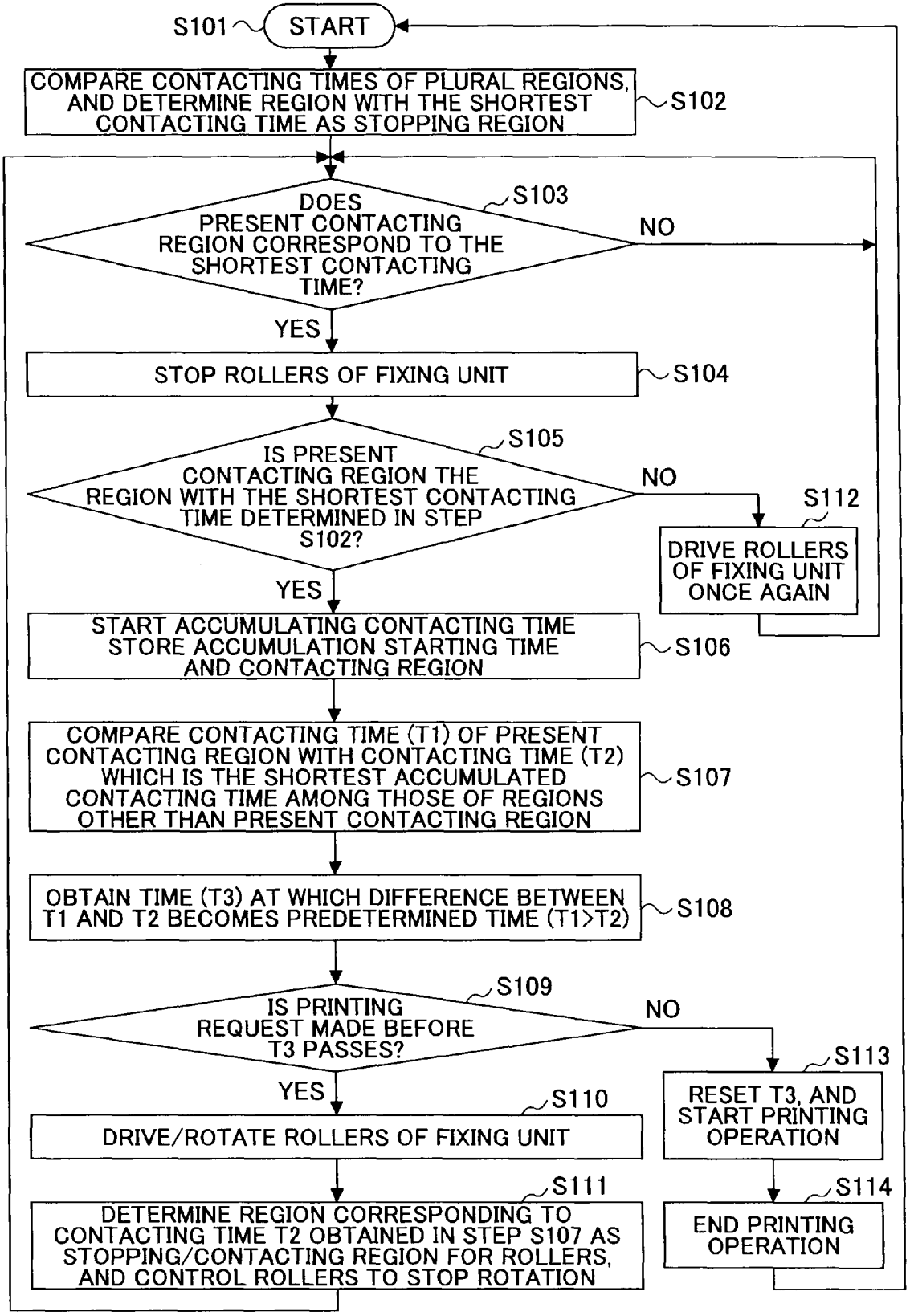
FIG. 6 is a main flow chart of processing procedures of a stop control operation for the fixing roller.

FIG. 6 is a main flow chart of processing procedures of the stop control operation for the fixing roller. The flow chart includes procedures starting from when the two rollers stop rotating after a printing operation ends, to when the two rollers start rotating once again.

In the flow shown in FIG. 6, when the printing (image forming) operation of the image forming apparatus 1 ends, a control routine for stopping the rotation of the two rollers of the fixing unit 20 is started (step S101). First, the control system reads, from the information that is stored and managed by the storage unit 29, the contacting times of the plural separate regions, which regions are separated by dividing the surface of the fixing roller 21 in the rotational direction. Next, based on the contacting times of the plural regions that have been read, the stopping region determining unit 31 determines, from among the plural regions, the stopping region in which the two rollers are to contact each other when they stop rotating. At this step, the stopping region determining unit 31 compares the contacting times of the plural regions, and based on the comparison results, determines which one of these regions is to be the stopping region. A basic method performed at this step is to determine which region has the shortest contacting time among the plural regions, and this region is determined to be the stopping region (step S102).

Next, a contacting region detecting unit including the gear (1) 24 for driving the photosensor 23 and the fixing roller 21 (see FIGS. 2 and 3) and the main control unit 28 (see FIG. 5) detects the region in which the rotating two rollers are presently contacting each other. The contacting region detecting unit confirms whether this present contacting region corresponds to the region having the shortest contacting time determined in step S102 (step S103). As a result of the confirmation, when these regions do not correspond to each other (No in step S103), the operation of detecting the present contacting region and making the above confirmation is repeated at predetermined time intervals (for example, every ten milliseconds). When the regions correspond to each other (Yes in step S103), the contacting region detecting unit gives a stopping instruction to the driving system control unit 30, to stop the two rollers of the fixing unit 20 (step S104).

Figure 7:
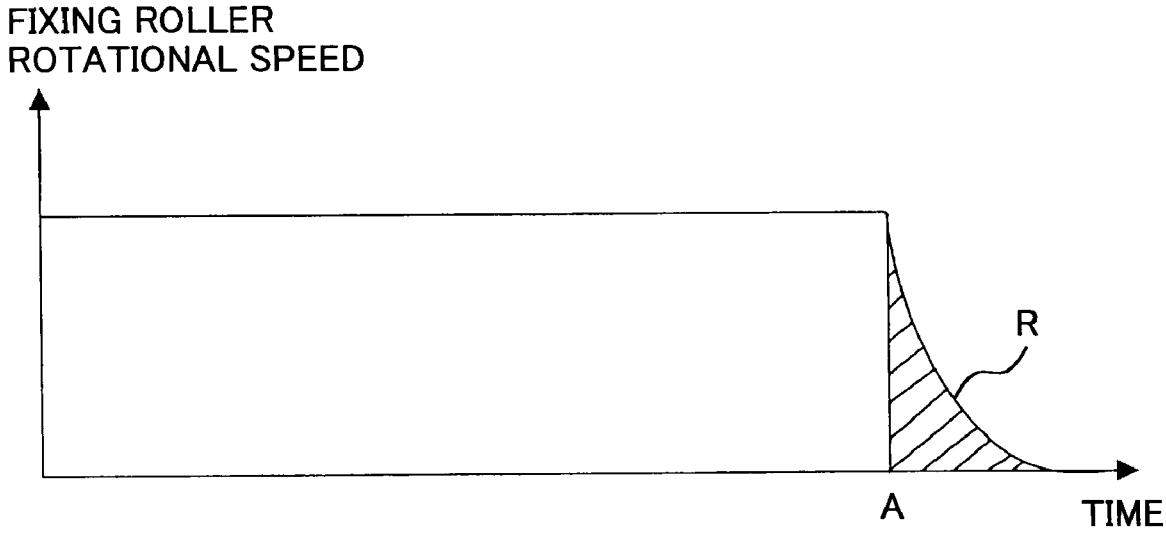
FIG. 7 illustrates operation properties when the fixing roller stops.

However, in the stop control operation, when the main control unit 28 instructs the two rollers to stop rotating, the rotational speed of the two rollers does not immediately become zero; the rotational speed will have characteristics as illustrated in FIG. 7.

That is, the contacting region determined by the stopping region determining unit 31 is detected at a time point A shown in FIG. 7, and the driving motor is also stopped at point A. However, the rotational speed decreases gradually as illustrated by a curve R in FIG. 7. Accordingly, the two rollers will not immediately stop, and therefore they may stop in an unintended area.

In this case, if the rotational speed was the same, the distance of rotation from when the motor stops until the fixing roller 21 stops would always be the same. Therefore, the distance from when the motor stops until the fixing roller 21 stops is obtained beforehand, and the motor is stopped in consideration of this distance. The rotational speed of the fixing roller 21 is 60 rpm or 30 rpm, and the distance until the fixing roller 21 stops is obtained beforehand. The timing of stopping the motor is adjusted according to the rotational speed.

The operation of stopping the two rotating rollers is controlled in the above manner, so that the two rollers stop in a state where they are contacting each other at the determined stopping region. In the present embodiment, as shown in the flow chart of FIG. 6, the present contacting region is detected once again as a matter of precaution, to confirm whether this present contacting region corresponds to the region having the shortest contacting time (step S105).

As a result of the confirmation, when these regions do not correspond to each other (No in step S105), the two rollers are rotated once again (step S112), and the steps S103 through S105 are repeated.

When the present contacting region corresponds to the determined region (Yes in step S105), the control system starts accumulating the contacting time, and stores the time of starting the accumulation and the present contacting region in the storage unit 29 (step S106).

As described above, the image forming apparatus 1 detects the present contacting region and identifies which one it corresponds to among the plural separate regions on the surface of one of the of two rollers of the fixing unit 20. During this operation, the contacting times of the two rollers are calculated for each of the plural regions. The contacting time of the two rollers is accumulated for each of the plural regions, which is stored and managed by the photosensor output detecting unit 27 as history information.

Furthermore, every time the two rollers are to be stopped, the image forming apparatus 1 determines, from among the plural regions, the stopping region in which the two rollers are to contact each other when they stop rotating in the same manner as above. This determination is made based on the contacting times being managed by the photosensor output detecting unit 27. Then, the two rollers are stopped so that they contact each other in the determined stopping region.

By performing such operations, the plural contacting regions are equally (evenly) used, so that unevenness is prevented (so that the two rollers of the fixing unit 20 do not always contact each other in the same region). Accordingly, the damage caused by heat and pressure can be distributed across the surfaces of the two rollers, thereby mitigating damages and deformation on the surfaces of the two rollers, so that the operating life of the fixing unit 20 is increased.

[Operation for Changing Contacting Region when Fixing Roller is Stopped]

Next, when rotation of the two rollers is stopped, the contacting times of the plural regions managed as history information are compared at predetermined time intervals. Based on these comparison results, when a predetermined condition is satisfied or a predetermined relationship is established, the stopping region determining unit 31 determines to change the stopping region for the two stopped rollers to another region.

In the present embodiment, the stopping region determining unit 31 compares the accumulated contacting time of the region in which the two rollers are presently contacting each other, with a minimum (shortest) contacting time of a region other than the present region. When the difference in the contacting times that have been compared is more than or equal to a predetermined time, the two rollers are rotated once again. Specifically, when it is confirmed that the contacting time of the present contacting region is definitely not the shortest anymore, and that it exceeds a value set in consideration of a predetermined margin, the two rollers are rotated once again. Furthermore, the stopping region for the two rollers is changed to the region with which the comparison was made (to the region with the shortest contacting time). Next, according to this determination, the driving system control unit 30 controls the rotation of the two stopped rollers by procedures of the flow of FIG. 6, so that the two rollers contact each other in the new stopping region when they stop, thereby performing the stop control operation.

In the flow of the operation in FIG. 6, while the two rollers are stopped, the contacting time of the region (stopping region) in which the two rollers are presently contacting each other is accumulated. This accumulated contacting time (T1) is compared with a contacting time (T2) which is the shortest accumulated contacting time among those of the regions other than the present contacting region (step S107). Next, when T1 becomes longer than T2, i.e., when T2 becomes the shortest contacting time, the stopping region determining unit 31 calculates a time (T3) when the difference between T1 and T2 becomes a predetermined time (e.g., 15 minutes) (step S108).

Subsequently, it is confirmed whether there is a printing request before the calculated time (T3) passes (step S109). When a printing request is made (No in step S109), T3 is reset and a printing operation starts (step S113). Subsequently, when the printing operation ends (step S114), the flow returns to step S101 and the above operations and procedures are repeated.

When a printing request is not made before T3 passes (Yes in step S109), the driving system control unit 30 starts rotating the two rollers of the fixing unit 20 once again (step S110).

Next, in accordance with the determination made by the stopping region determining unit 31 to use the region having the shortest contacting time (T2) obtained in step S107 as the stopping region where the two rollers stop and contact each other, the main control unit 28 controls the rotation of the two rollers to stop them at the stopping region (step S111). The flow returns to step S103 and the operations and procedures from step S103 onward are repeated.

In this manner, in addition to the "basic operation of stop control operation", while the two rollers are stopped, the accumulated contacting time is constantly compared with the accumulated contacting times of the other regions. When the relationship between the contacting times satisfies a predetermined condition, the two rollers are rotated once again.

According to a value obtained from the accumulated times, the stopping region for the two rollers is changed.

By performing such operations, unevenness in the stopping regions, which leads to damages and deformation on the surfaces of the two rollers of the fixing unit 20, can be mitigated, thereby further increasing the operating life of the fixing unit 20.

In the present embodiment, while the two rollers of the fixing unit 20 are stopped, the contacting times are compared. According to the comparison results, the two rollers are rotated once again and the stopping region is changed. However, as a matter of course, the procedures of changing the stopping region can also be performed other than during regular operations, such as while the image forming apparatus 1 is in an energy saving mode or during a preheating mode.

[Management of Contacting Time when Main Power is Turned Off (1)]

In the above-described control system (FIG. 6), even when the main power (power switch for operating the apparatus) is turned off and the apparatus is stopped, it is possible to accumulate the contacting time until the apparatus starts operating once again.

The storage unit 29 stores the time every second. When the main power is turned off, the storage unit 29 stores this time. When the main power is turned off while the two rollers of the storage unit 29 are being driven (rotated) and the power is turned on once again, the storage unit 29 obtains a main power stopping time extending from when the main power is turned off to when the main power starts operating once again.

The driving system control unit 30 drives the fixing roller 21 of the two rollers, and when the slit 24S of the gear (1) 24 passes through the photosensor 23, the main control unit 28 determines whether the slit 24S is large or small. When the determination is correctly made, the storage unit 29 determines the present contacting region based on the number of counts that are presently held. The main power stopping time, which has been obtained when the main power started operating again, is added and stored as the contacting time of the present contacting region.

There may be a case where the main power is stopped while the fixing roller 21 is being driven, and the slit 24S of the gear (1) 24 passes through the photosensor 23 while the main power is stopped. In this case, the same one (same size) of the slits 24S of the gear (1) 24 will be consecutively sensed by the photosensor 23 twice. Accordingly, it can be detected that one of the slits 24S of the gear (1) 24 has passed through the photosensor 23 while the main power is stopped. Therefore, the contacting region corresponding to the one before the present contacting region that is obtained based on the count number of the slits 24S, is determined to be the contacting region while the main power is stopped. Thus, the contacting time can be accumulated for the correct contacting region.

Figure 8:
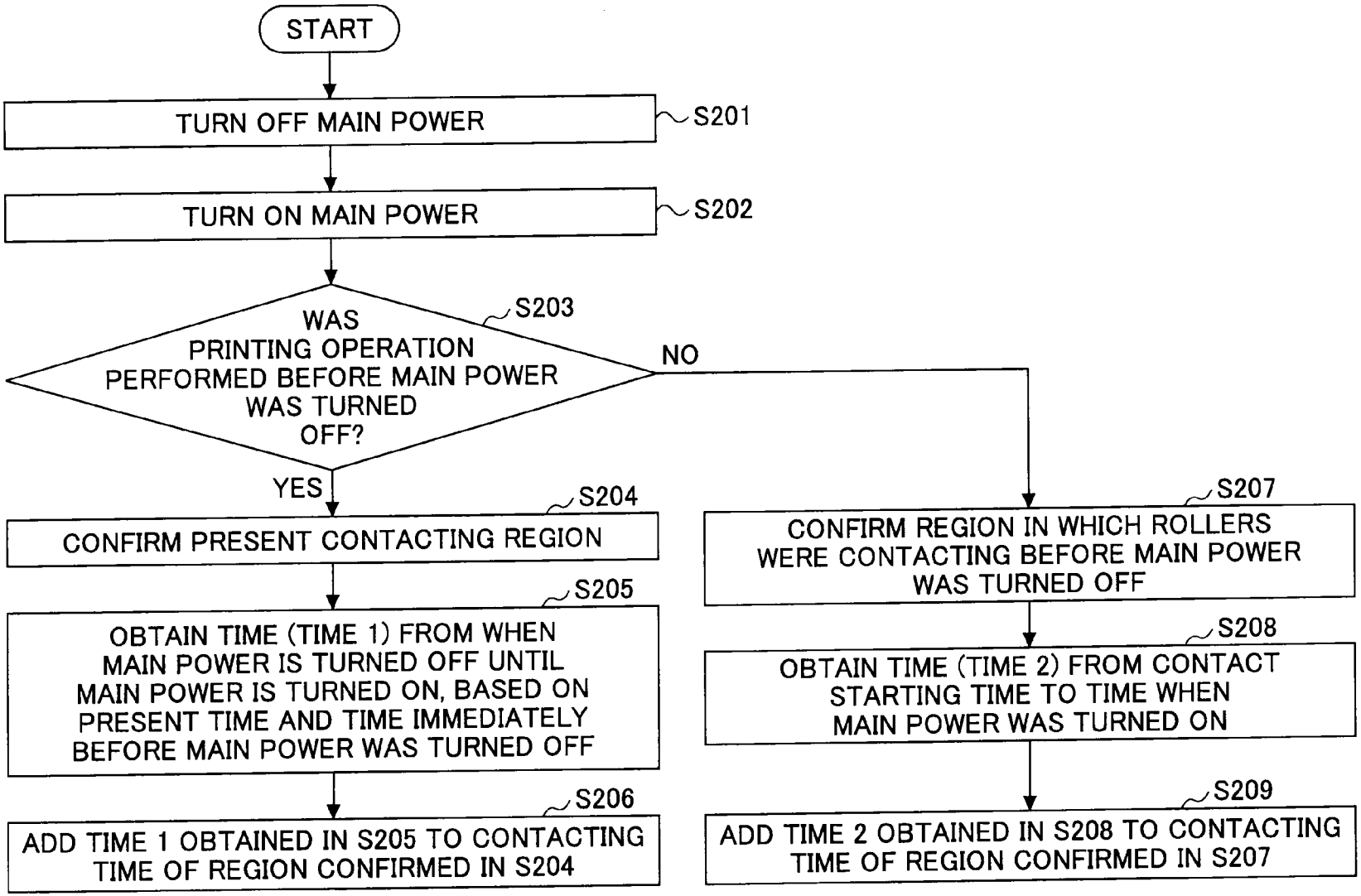
FIG. 8 is a flowchart indicating operation procedures for managing the contacting time while the main power is turned off.

FIG. 8 is a flowchart indicating operation procedures for managing the contacting time while the main power is turned off.

These operation procedures start when the main power has been turned off in one of the steps of the flowchart (FIG. 6) of the stop control operation for the fixing roller.

The main power is turned off (step S201) and is then turned on once again (step S202). Subsequently, it is determined whether the two rollers of the fixing unit 20 were being rotated, or whether they were in a standby status waiting for a printing operation (print standby status), before the power was turned off (step S203).

While the main power is turned on, when a printing request is made, information indicating that a printing operation is being performed is stored in the storage unit 29, and when the printing operation ends, information indicating that the apparatus is in a print standby status is stored in the storage unit 29. The above described determinations are made based on the information stored in the storage unit 29. Furthermore, the present time is revised and stored in the storage unit 29 every second. The time at which the main power is turned off is stored as a main power off time. Therefore, even if the main power is turned off, the time at which the main power had been turned off can be recognized when the main power is turned on once again.

As a result of the determination made in step S203, when it is determined that a printing operation was being performed before the main power was turned off (Yes in step S203), the photosensor output detecting unit 27 detects and confirms the region in which the two rollers are presently contacting each other (step S204).

Furthermore, the difference between the present time and the time stored in the storage unit 29 which is immediately before the main power was turned off is calculated, to obtain the time (Time 1) from when the main power is turned off until the main power is turned on (step S205).

Next, the obtained time (Time 1) is added (accumulated) to the contacting time of the present contacting region confirmed in step S204 (step S206), and the accumulated value is stored in the storage unit 29.

Conversely, as a result of the determination made in step S203, when it is determined that the apparatus was in a print standby status before the main power was turned off (No in step S203), the region in which the two rollers were contacting each other before the main power was turned off is confirmed (step S207). That is, if a printing operation was not being performed before the main power was turned off, it means that the two rollers had been stopped, and the contacting time of the contacting region had been accumulated. Therefore, the corresponding region and the contact starting time would have been stored in the storage unit 29. Accordingly, the region in which the two rollers were contacting each other and the contact starting time before the main power was turned off are known, based on the information stored in the storage unit 29. Therefore, based on the information stored in the storage unit 29, the contacting region before the main power was turned off is confirmed, and a time (Time 2) is obtained by calculating the difference between the contact starting time in this region and the time at which the main power was turned on (step S208). Next, this time (Time 2) is added (accumulated) to the contacting time of the present contacting region confirmed in step S207 (step S209), and the accumulated value is stored in the storage unit 29.

As described above, in the image forming apparatus 1, the off time at which the main power is turned off to stop the apparatus is stored, and when the main power is turned on to start operating the apparatus once again, the elapsed time between the on time and the stored off time is calculated.

Subsequently, the calculated elapsed time is accumulated to the contacting time corresponding to one of the plural regions and stored in the storage unit 29, and the accumulated contacting time is used for the stop control operation for the fixing roller, which is performed when the printing operation ends (see FIG. 6).

[Adjustment of Contacting Time According to Temperature Condition]

The fixing roller 21 and the pressurizing roller 22 are in pressure-contact with each other, and therefore the contacting surfaces may be damaged and deformed. As the temperature increases, the contacting surfaces will be more damaged and deformed. Therefore, if no consideration is made of the temperature conditions, with the stop control method of determining the stopping region of the fixing roller based on the contacting time that is obtained by uniformly calculating the time that the two rollers are in contact, there is no guarantee of obtaining the optimum controlling conditions for evening out the damages and deformations across the contacting surface.

Accordingly, in the following configuration, there is added a unit for evening out the damages and deformations across the contacting surface to address this problem. In this example, the contacting time described in the above embodiment, i.e., the contacting time that is managed and accumulated for each of the plural separate regions on the contacting surface of the fixing roller 21, is adjusted according to temperature conditions. The adjusted value is reflected in the stop control operation so that the damages and deformations can be distributed (evened out) across the contacting surface.

Methods of adjusting the contacting time based on temperature conditions can be generally classified into the following two methods, method (I) and method (II).

Method (I): The fixing temperature while the two rollers of the fixing unit 20 are stopped is detected at predetermined time intervals, to obtain the fixing temperature in time-series while the two rollers are in contact. The contacting time is adjusted in accordance with the fixing temperature that changes in time-series.

Method (II): By detecting the fixing temperature of the time point when the two rollers of the fixing unit 20 are stopped, the temporal change in the fixing temperature is estimated. The contacting time is adjusted based on the relationship between the estimated temperature condition.

Embodiments of the method (I) and the method (II) are described in detail below. In either method, it is necessary to detect the fixing temperature. Therefore, in order to adjust the contacting time, the thermistor 33 and the fixing temperature detecting unit 32 are provided as shown in FIG. 5, as elements configuring the control system.

The fixing temperature detecting unit 32 detects the input to the thermistor 33 provided in the fixing unit 20, converts the input into temperature information, and reports the present temperature of the fixing unit 20 to the storage unit 29. The storage unit 29 stores this present temperature. This operation is constantly performed at intervals of 0.5 seconds. The temperature condition obtained from the fixing temperature detected by the fixing temperature detecting unit 32 is associated with a contacting time, to adjust the contacting time to the target contacting time.

"Adjustment of Contacting Time (1) by Method (I)"

First, as an embodiment of the method (I), a description is given of an example of adjusting the contacting time by accumulating the contacting time only when the detected temperature of the fixing unit 20 is more than or equal to a predetermined value.

Figure 9:
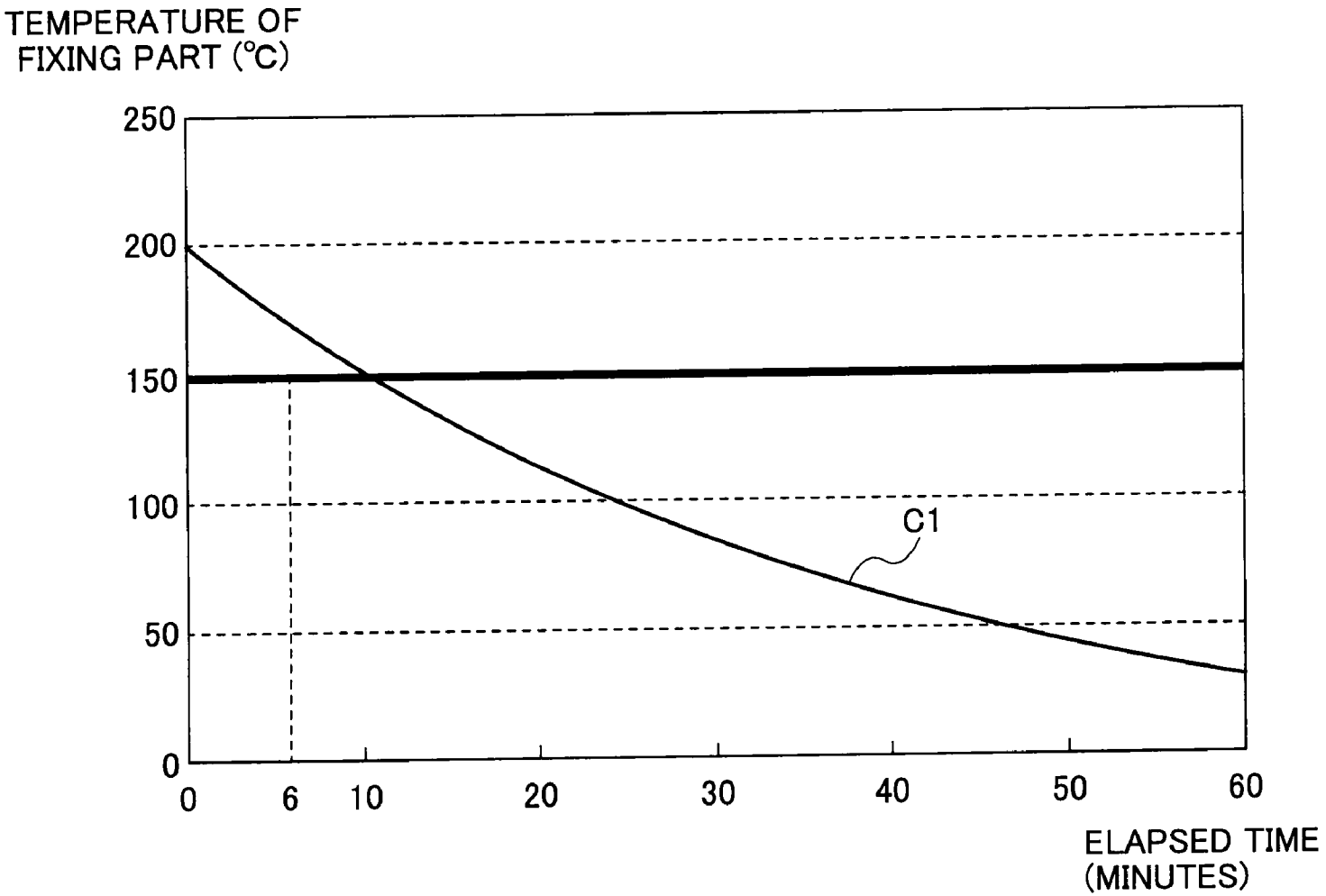
FIG. 9 is a graph indicating the change in temperature after the fixing unit is stopped and the accumulated contacting time.

When the fixing unit 20 stops operating, the temperature of the fixing part changes with the passage of time as indicated by a property line C1 in the graph of FIG. 9. The vertical axis of FIG. 9 indicates the temperature (° C.) detected by the thermistor 33, and the horizontal axis indicates the elapsed time (minutes), where zero corresponds to when the fixing unit 20 stops operating.

As indicated by the property line C1, the temperature gradually decreases with the passage of time after the fixing unit 20 stops operating.

The temperature has such a property, and therefore when the temperature drops below a predetermined value, the temperature condition beyond this point is hardly likely to cause damages or deformation on the contacting surface. Accordingly, in the present embodiment, only when the temperature of the fixing unit 20 is more than or equal to 150° C., the contacting time is accumulated so as to be managed by the storage unit 29, and the impact of the temperature of less than 150° C. is disregarded. Therefore, the amount of data as well as the processing load required for processing the data can be reduced.

Figure 11:
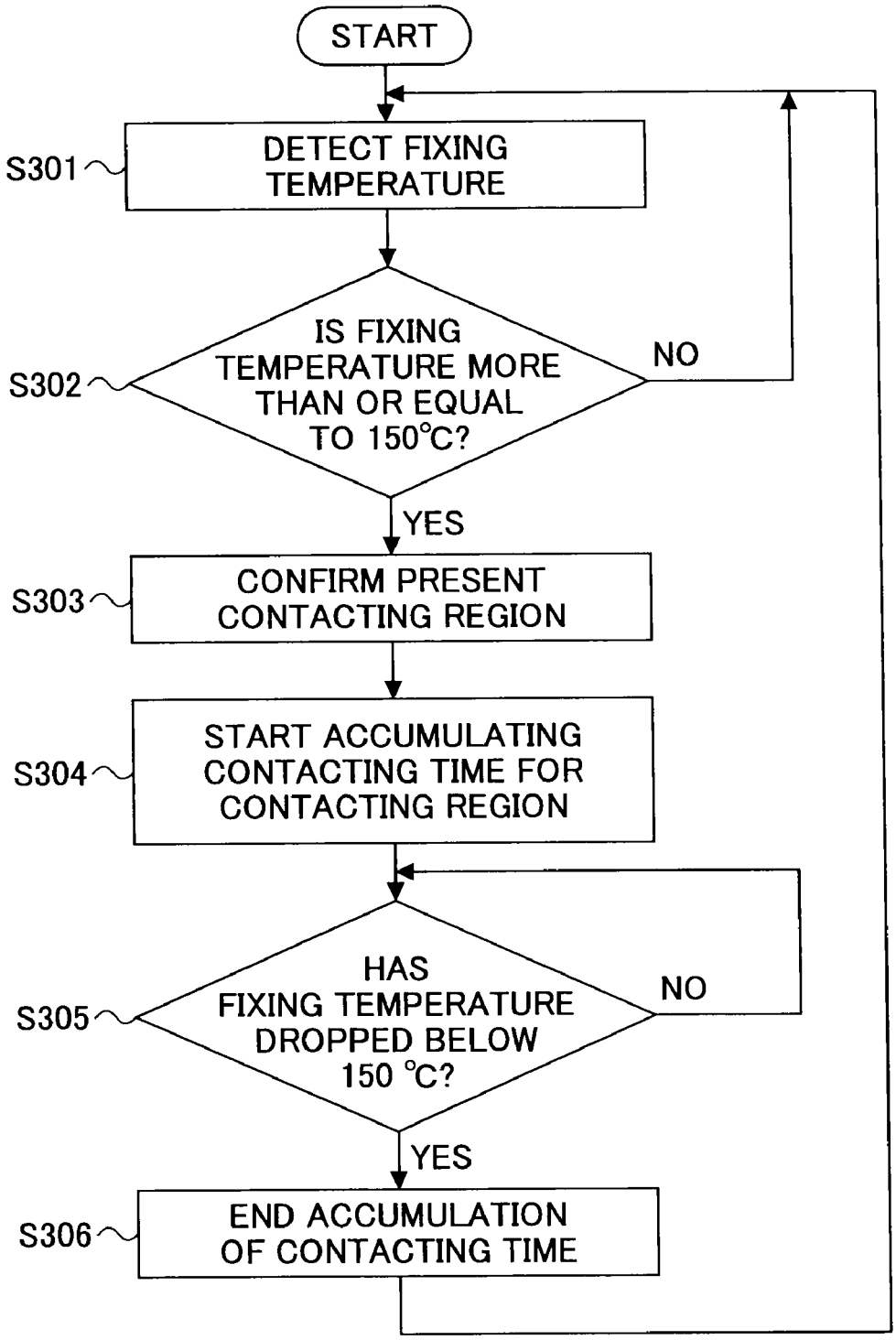
FIG. 11 is a flowchart of operation procedures for accumulating the contacting time only when the temperature of the fixing part is more than or equal to a predetermined value.

FIG. 11 is a flowchart of operation procedures according to the present embodiment, for accumulating the contacting time only when the temperature of the fixing part is more than or equal to a predetermined value. In this example, the contacting time is accumulated when the temperature of the fixing part is more than or equal to 150° C.

This operation procedure starts at step S106 of the flowchart (FIG. 6) of the stop control operation for the fixing roller described above, and is performed while the fixing roller is stopped.

In the flow shown in FIG. 11, first, the control system detects the temperature of the fixing part (step S301). The temperature is detected at intervals of 0.5 seconds by the fixing temperature detecting unit 32. Therefore, the actual value of the detected temperature is revised at this interval. However, in this example, the value detected by the fixing temperature detecting unit 32 is referred to at intervals of one second, so that the temperature is revised at intervals of one second.

Next, the control system determines whether the detected temperature of the fixing part is more than or equal to 150° C. (step S302). When the temperature is less than 150° C. (No in step S302), the flow returns to step S301, and the temperature of the fixing part is detected once again. When the temperature of the fixing part is less than 150° C. while the fixing roller is stopped, under normal circumstances, the temperature will not become more than or equal to 150° C. once again until the fixing part starts operating once again. Therefore, during this time, the process of accumulating the contacting time need not be performed.

On the other hand, when the temperature of the fixing part is more than or equal to 150° C. (Yes in step S302), the control system confirms the region in which the two rollers of the fixing unit 20 are presently contacting each other, i.e., the control system identifies one of the separate regions on the contacting surface by checking the count number (step S303), and starts accumulating the contacting time for the identified region (step S304).

Subsequently, the control system determines whether the temperature of the fixing part has dropped below 150° C. (step S305). When the temperature has not dropped below 150° C. (No in step S305), the control system repeats this step at intervals of one second, and continues to accumulate the contacting time. When the temperature has dropped below 150° C. (Yes in step S305), the control system ends the operation of accumulating the contacting time (step S306). Although not shown in the flow of FIG. 11, when a print request is made, the flow proceeds to step S306 and the operation of accumulating the contacting time ends.

"Adjustment of Contacting Time (2) by Method (I)"

In the above "adjustment of contacting time (1) by method (I)", the contacting time is accumulated only when the detected temperature of the fixing part is more than or equal to a predetermined value. In this example, the detected temperature of the fixing part is divided into plural temperature segments. A coefficient corresponding to each segment is determined, and the contacting time is converted into a reference contacting time by this coefficient to adjust the contacting time.

For example, the temperature of the fixing part is divided into three segments of "more than or equal to 200° C.", "more than or equal to 150° C. and less than 200° C.", and "less than 150° C.". A coefficient is associated with each of these three temperature segments, i.e., three times for "more than or equal to 200° C.", two times for "more than or equal to 150° C. and less than 200° C.", and one time for "less than 150° C.". That is, the contacting time of the temperature segment of "less than 150° C." is used as a reference, to convert the contacting time for "more than or equal to 200° C." with the coefficient of three times, and to convert the contacting time for "more than or equal to 150° C. and less than 200° C." with the coefficient of two times.

In this example, to manage the contacting time for each contacting region, assuming that the contacting time at each temperature segment is 10 minutes, 10 minutes is multiplied by the coefficient of each temperature segment to calculate the converted value of the contacting time as follows:

10 minutes×3 (coefficient of "more than or equal to 200° C.")+10 minutes×2 (coefficient of "more than or equal to 150° C. and less than 200° C.")+10 minutes×(coefficient of "less than 150° C.")=60 minutes By performing this method, the contacting time can be adjusted more appropriately compared to the case of "adjustment of contacting time (1) by method (I)".

Figure 12:
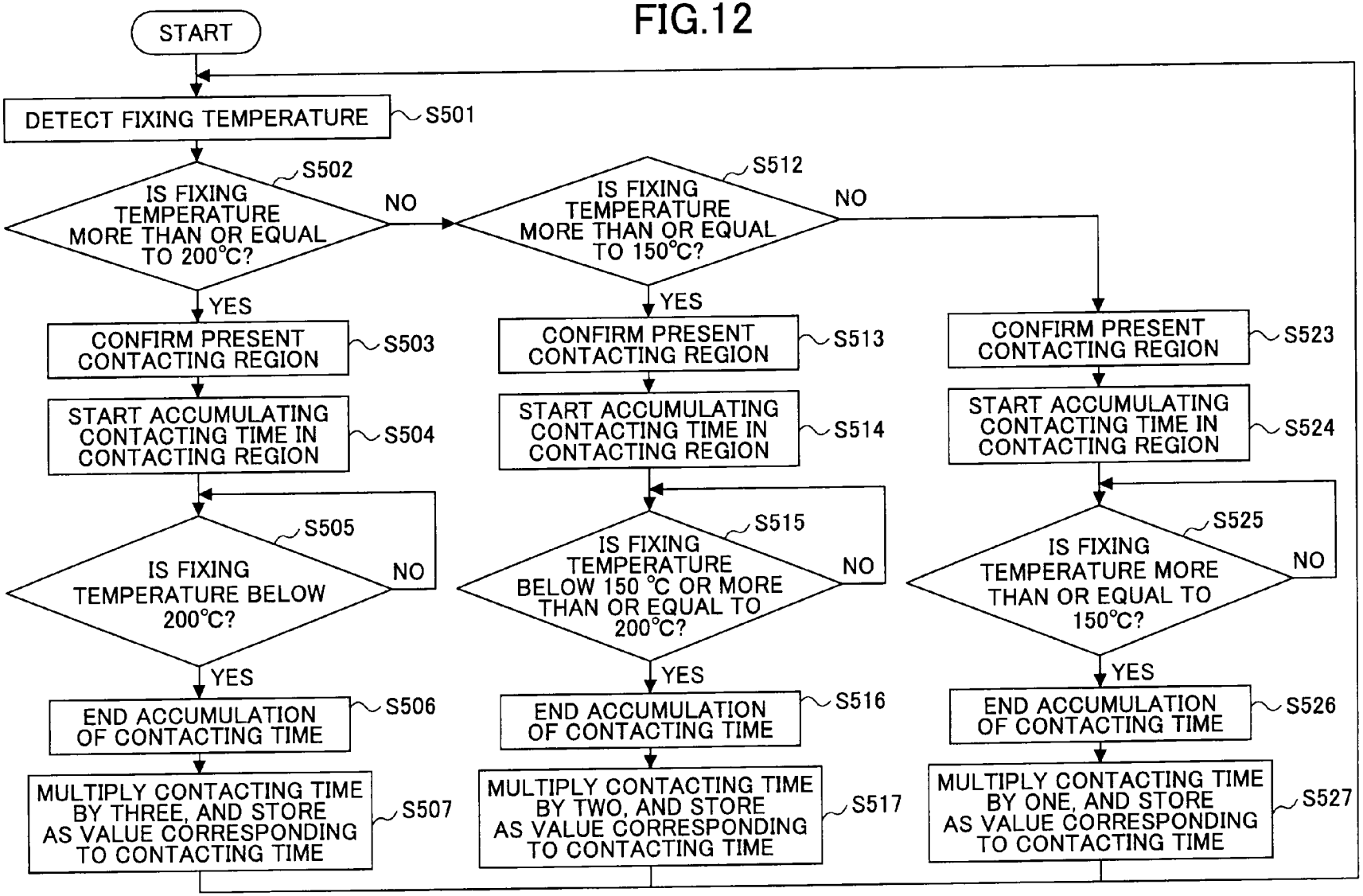
FIG. 12 is a flowchart indicating operation procedures for accumulating the contacting time in which the contacting time is adjusted according to temperature segments.

FIG. 12 is a flowchart indicating operation procedures for accumulating the contacting time according to the present embodiment, in which the contacting time is adjusted according to temperature segments of the fixing part. In this example, the temperature of the fixing part is divided into the three temperature segments as described above.

This operation procedure starts at step S106 of the flowchart (FIG. 6) of the stop control operation for the fixing roller described above, and is performed while the fixing roller is stopped.

In the flow of FIG. 12, first, the control system detects the temperature of the fixing part (step S501). The temperature is detected at intervals of 0.5 seconds by the fixing temperature detecting unit 32. Therefore, the actual value of the detected temperature is revised at this interval. However, in this example, the value detected by the fixing temperature detecting unit 32 is referred to at intervals of one second, so that the temperature is revised at intervals of one second.

Next, the control system determines whether the detected temperature of the fixing part is more than or equal to 200° C. (step S502). When the temperature of the fixing part is more than or equal to 200° C. (Yes in step S502), the control system confirms the region in which the two rollers of the fixing unit 20 are presently contacting each other, i.e., the control system identifies one of the separate regions on the contacting surface by checking the count number (step S503), and starts accumulating the contacting time for the identified region (step S504).

Subsequently, the control system determines whether the temperature of the fixing part has dropped below 200° C. (step S505). When the temperature has not dropped below 200° C. (No in step S505), the control system repeats this step at intervals of one second, and continues to accumulate the contacting time. When the temperature has dropped below 200° C. (Yes in step S505), the control system ends the operation of accumulating the contacting time (step S506).

At the time point when accumulation of the contacting time for this temperature segment ends, the control system adjusts the accumulated contacting time by multiplying it by three times, and the obtained value is stored and managed by the storage unit 29 (step S507). In this flow, the conversion of the contacting time by multiplying it by three times is not performed until step S505 becomes "yes". However, the conversion may be performed while waiting until step S505 becomes "yes".

Subsequently, the flow returns to step S501 of detecting the temperature of the fixing part.

When the temperature of the fixing part detected in step S502 is less than 200° C. (No in step S502), the flow proceeds to step S512, where the control system determines whether the detected temperature of the fixing part is "more than or equal to 150° C." (step S512). When the temperature of the fixing part is more than or equal to 150° C. (Yes in step S512), the control system confirms the region in which the two rollers of the fixing unit 20 are presently contacting each other, i.e., the control system identifies one of the separate regions on the contacting surface by checking the count number (step S513), and starts accumulating the contacting time for the identified region (step S514).

Subsequently, the control system determines whether the detected temperature of the fixing part is "less than 150° C." or "more than or equal to 200° C." (step S515). When the temperature is neither "less than 150° C." nor "more than or equal to 200° C." (No in step S515), the control system repeats this step at intervals of one second, and continues to accumulate the contacting time. When the temperature is either "less than 150° C." or "more than or equal to 200° C." (Yes in step S515), the control system ends the operation of accumulating the contacting time (step S516).

At the time point when accumulation of the contacting time for this temperature segment ends, the control system adjusts the accumulated contacting time by multiplying it by two times, and the obtained value is stored and managed by the storage unit 29 (step S517).

Subsequently, the flow returns to step S501 of detecting the temperature of the fixing part.

When the temperature of the fixing part detected in step S512 is less than 150° C. (No in step S512), the flow proceeds to step S523, where the control system confirms the region in which the two rollers of the fixing unit 20 are presently contacting each other, i.e., the control system identifies one of the separate regions on the contacting surface by checking the count number (step S523), and starts accumulating the contacting time for the identified region (step S524).

Subsequently, the control system determines whether the detected temperature of the fixing part is "more than or equal to 150° C." (step S525). When the temperature is not "more than or equal to 150° C." (No in step S525), the control system repeats this step at intervals of one second, and continues to accumulate the contacting time. When the temperature is "more than or equal to 150° C." (Yes in step S525), the control system ends the operation of accumulating the contacting time (step S526).

At the time point when accumulation of the contacting time for this temperature segment ends, the control system does not adjust the accumulated contacting time, so that the obtained value which is only multiplied by one is stored and managed by the storage unit 29 (step S527).

Subsequently, the flow returns to step S501 of detecting the temperature of the fixing part.

"Adjustment of Contacting Time by Method (II)"

In method (II), in the fixing unit 20, the motor and the heater for driving the two rollers are stopped, and the temperature at the fixing part is detected when the fixing operation is stopped. Accordingly, the temporal change in the temperature can be estimated without actual measurement.

The estimated value is obtained by applying data that has been obtained beforehand by performing an experiment under the same condition. Specifically, variations of temperature properties are obtained by measuring the temporal change in the temperature while the fixing unit is stopped, in experiments performed for different temperature conditions. Among these variations, the property that matches the temperature condition when the fixing unit is stopped is selected, and based on the selected property, the temporal change in the temperature is estimated.

By performing this method of estimating the temporal change in the temperature, it is only necessary to detect the temperature at the time point when the two rollers are stopped, and no subsequent detections need to be performed. Furthermore, even in a case where the main power is turned off such that control operations are disabled and temperature changes based on actual measurements cannot be detected, the estimated value can be used for compensating for such a situation.

Figure 10:
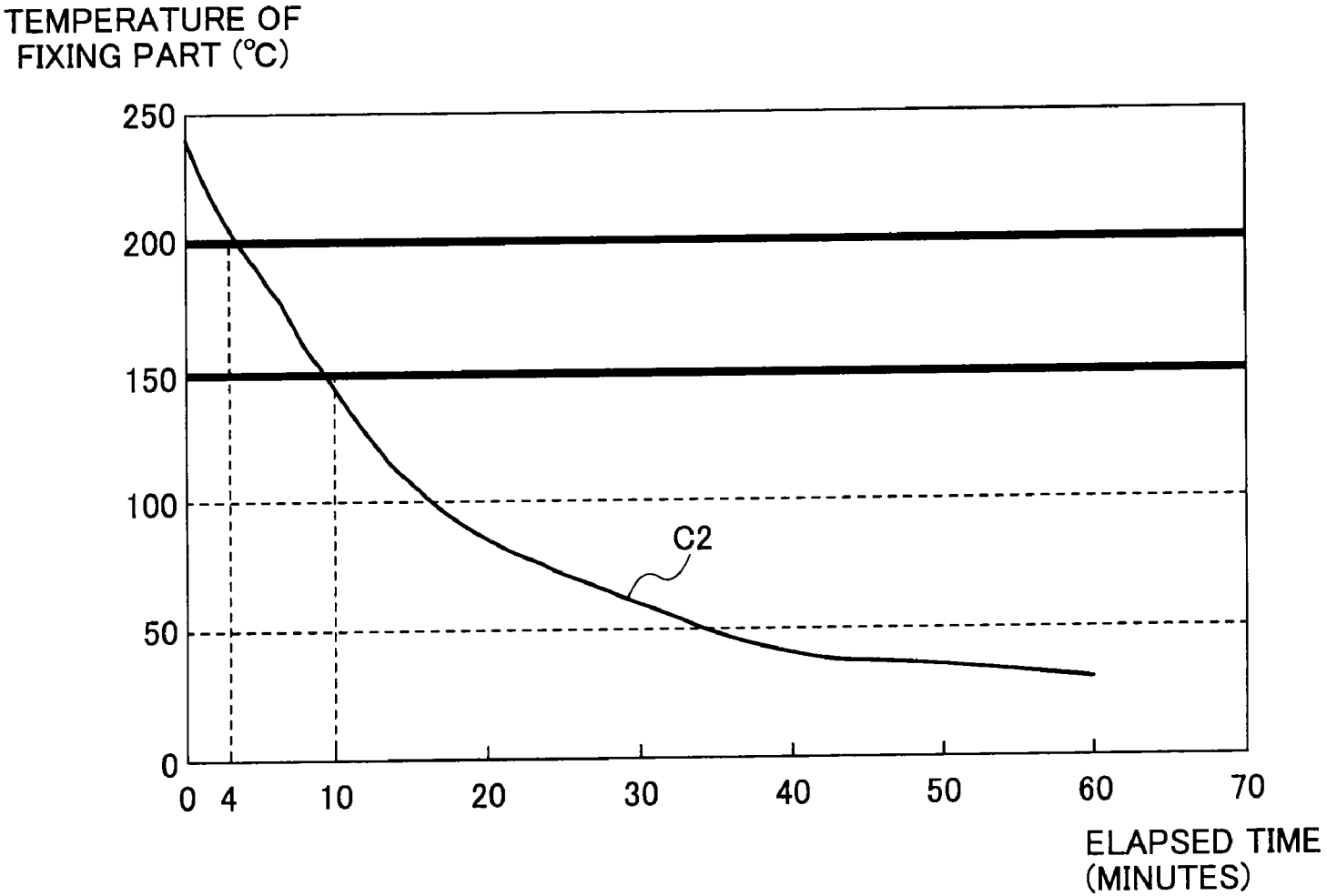
FIG. 10 is a graph indicating the change in temperature after the fixing unit is stopped and the accumulated contacting time in temperature segments.

FIG. 10 is a graph indicating experimental data of the temporal change in the temperature at the fixing part from the time point when the fixing operation in the fixing unit 20 is stopped. The vertical axis of FIG. 10 indicates the temperature (° C.) of the fixing part, and the horizontal axis indicates the elapsed time (minutes), where zero corresponds to when the fixing unit 20 stops operating. The data indicating the temporal change in the temperature is detected by the thermistor 33 in the image forming apparatus 1 under conditions near actual conditions.

In the example shown in FIG. 10, the temperature of the fixing part detected when the fixing operation is stopped is 240° C., and a property line C2 expresses the measured relationship between the temperature (° C.) of the fixing part and the elapsed time (minutes) thereafter.

Data expressing such a temperature property is measured beforehand in experiments, for obtaining variations in increments of 20° C., with the starting temperature varying from 106° C. through 240° C.

The contacting time while the fixing operation is stopped can be obtained based on the temporal change in the temperature at the fixing part estimated by the method (II) in the following manner. Specifically, the control system acquires a corresponding one from among variations of data expressing the temperature properties managed by the storage unit 29, based on the starting temperature used for estimating the temporal change in the temperature. For example, it is assumed that the temperature at the fixing part detected at the time point when the fixing operation is stopped is 240° C. Then, an estimated value is obtained by referring to data expressing the temperature property indicating the temporal change from the starting temperature of 240° C., shown in FIG. 10. In the example shown in FIG. 10, a temperature segment from 200° C. through 150° C. is set. The contacting time for this segment, i.e., the time taken for the temperature to change from 200° C. to 150° C., is obtained by performing calculation according to data expressing the temperature property shown in FIG. 10 (the elapsed time at 150° C.—the elapsed time at 200° C.). As a result of the calculation, an estimated value of six minutes can be obtained.

Based on this estimated value, the contacting time can be adjusted for the temperature segment of 200° C. through 150° C. The adjustment method can be performed in the same manner as the "adjustment of contacting time (2) by method (I)".

The above example is applied to a case when the fixing operation is stopped. However, this method can also be applied to a case of estimating the temporal change in the temperature at the fixing part after the main power is turned off. For this case, a variation in which the starting temperature is 100° C. is prepared, which is a relatively low temperature.

In the above example, in the variations of data expressing temperature properties (see FIG. 10) prepared beforehand, the starting temperature conditions are varied. However, the temporal change in the temperature can also be affected by the temperature of the environment (atmospheric temperature) in which the image forming apparatus 1 is installed.

To address this problem, a unit for compensating for changes in the atmospheric temperature is provided. In this example, three types (high temperature/middle temperature/low temperature) of data items are created according to the atmospheric temperature, as variations in the data expressing temperature properties (see FIG. 10), and the three data items are stored in the storage unit 29 beforehand. Furthermore, the temperature sensor 35 and the atmospheric temperature detecting unit 34 are provided as configuration elements of the control system of the image forming apparatus 1 as shown in FIG. 6.

The atmospheric temperature detecting unit 34 detects the input to the temperature sensor 35, converts the input into temperature information, and reports the atmospheric temperature of the image forming apparatus 1 to the storage unit 29. The storage unit 29 stores this atmospheric temperature. This operation is constantly performed at intervals of, for example, one second. In detecting the atmospheric temperature at intervals of one minute, abnormal detections can be compensated for by averaging plural detection values.

When data expressing temperature properties (see FIG. 10) is used, it is determined as to whether the detected atmospheric temperature is high temperature/middle temperature/low temperature. Data that matches the detected atmospheric temperature is selected from among variations of data (see FIG. 10) prepared beforehand, expressing temperature properties corresponding to atmospheric temperature of high temperature/middle temperature/low temperature.

[Management of Contacting Time when Main Power is Turned Off (2)]

When the main power (power switch for operating the apparatus) is turned off and the apparatus is stopped, and the time until the apparatus starts operating once again is accumulated as the contacting time, if the method of obtaining the contacting time with an estimated value by the above described "method (II) of adjusting the contacting time" is performed, an erroneous contacting time may be obtained, depending on the time until the apparatus starts operating. That is, if the apparatus starts operating before the estimated time comes, the accumulated time will be longer than the actual time. In this example, such a disadvantage is addressed.

This disadvantage is solved by the method described below. That is, when the main power is turned on once again, a contacting time T1 is obtained, based on the temperature of when the main power is turned off which is stored in the storage unit 29, by the "method (II) of adjusting the contacting time" performed by obtaining the contacting time with an estimated value. Meanwhile, a main power stopping time T2 is obtained by saving the time when the main power is turned off and the time when the main power is turned on once again. The appropriate contacting time is selected from the contacting time T1 or the main power stopping time T2. Specifically, when the main power stopping time T2 is longer than the contacting time T1, the contacting time T1 is selected. When the main power stopping time T2 is shorter than the contacting time T1, the main power stopping time T2 is selected. The selected time is accumulated as the contacting time managed by the storage unit 29.

Figure 13:
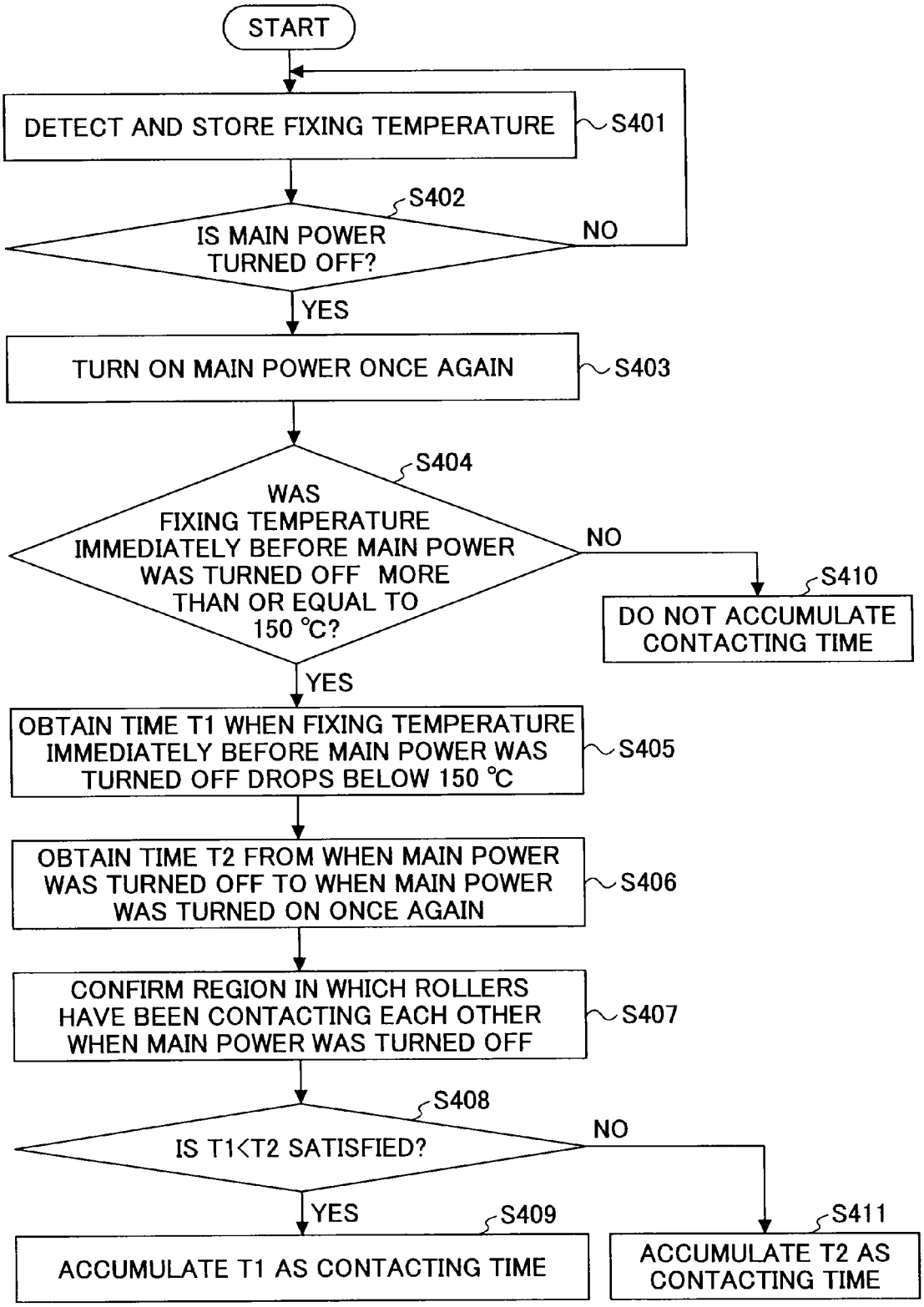
FIG. 13 is a flowchart of operation procedures for accumulating the contacting time when the main power is turned off.

FIG. 13 is a flowchart of operation procedures for managing the contacting time when the main power is turned off.

These operation procedures start when the main power has been turned off in one of the steps of the flowchart (FIG. 6) of the stop control operation for the fixing roller.

In the example taken in the following flow, the contacting time is not accumulated when the temperature of the fixing part is less than 150° C.

In the flow of FIG. 13, first, the temperature of the fixing part is detected, and the detected temperature is stored and managed by the storage unit 29 (step S401). This operation of detecting the temperature is performed every second as long as the main power is turned on (No in step S402), and the time of detection is also stored in the storage unit 29.

When the main power is turned off (Yes in step S402), the control operation of the main control unit 28 is stopped, including the temperature detecting operation.

When the main power is turned on once again (step S403), the control system reads the temperature of the fixing part detected and stored in step S401 immediately before the main power was switched off, and confirms whether this temperature is more than or equal to 150° C. (step S404).

As a result of the confirmation, when the temperature is less than 150° C. (No in step S404), it is assumed that the temperature will not increase while the main power is turned off, and therefore the contacting time is not accumulated (step S410).

On the other hand, when the temperature is more than or equal to 150° C. (Yes in step S404), the control system obtains a time T1 until the temperature of the fixing part, which was detected immediately before the main power was turned off, drops below 150° C. (step S405). For example, when the temperature is 190° C., the time T1 until this temperature drops below 150° C. (e.g., six minutes) is obtained with the use of data (see FIG. 10) expressing the temperature property in which the starting point is 200° C., which is closest to 190° C.

Next, the control system obtains a time T2 during which the main power was turned off, based on the time when the main power was turned off stored in step S401 immediately before the main power was turned off, and the time when the main power was turned on once again (step S406).

Subsequently, the control system confirms the region in which the two rollers of the fixing unit 20 have been contacting each other when the main power was turned off, i.e., the control system identifies one of the separate regions on the contacting surface by checking the count number (step S407).

When the contacting region is confirmed, the control system compares the time T1 obtained in step S405 and the time T2 obtained in step S406, and determines whether T1<T2 is satisfied (step S408).

When T1<T2 is satisfied (Yes in step S408), the time T1 (estimated value) is accumulated as the contacting time managed by the storage unit 29 (step S409).

When T1≧T2 is satisfied (No in step S408), the time T2 (time during which main power is turned off) is accumulated as the contacting time managed by the storage unit 29 (step S411).

[Management of Contacting Time when Main Power is Turned Off (3)]

In the above described "management of contacting time when main power is turned off (2)", even when the main power (power switch for operating the apparatus) is turned off and the apparatus is stopped, it is possible to accumulate the contacting time until the apparatus starts operating. However, this method does not consider adjusting the contacting time in accordance with temperature conditions.

In the present embodiment, a description is given of an example in which adjustments are made according to temperature conditions by applying the "adjustment of contacting time (2) by method (I)". In this example, the target of adjustment is the entire contacting time from when the main power is turned off until the main power is turned on once again. By performing the operation according to the present embodiment, the contacting time while the main power is turned off can be appropriately adjusted in consideration of temperature conditions.

Figure 14:
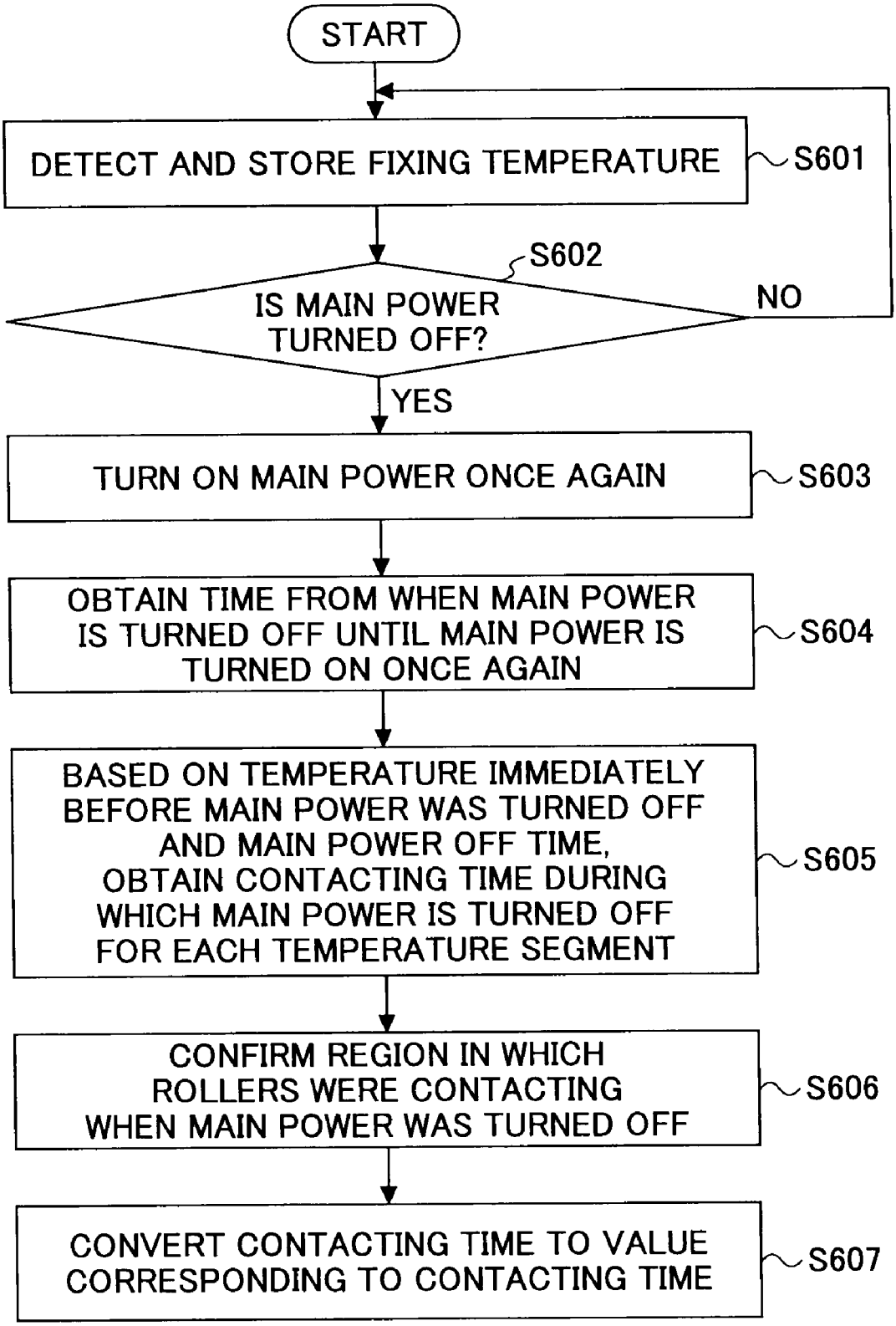
FIG. 14 is a flowchart of operation procedures for accumulating the contacting time when the main power is turned off, by making adjustments according to temperature segments.
Figure 15A:
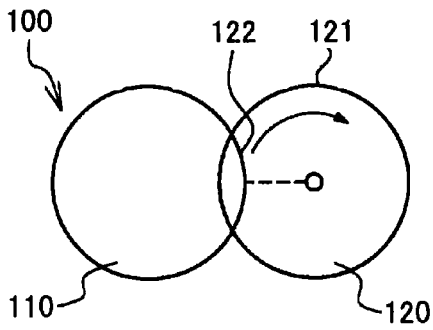
FIGS. 15A and 15B schematically illustrate a deformed state of rotating bodies in a conventional fixing unit.
Figure 15B:
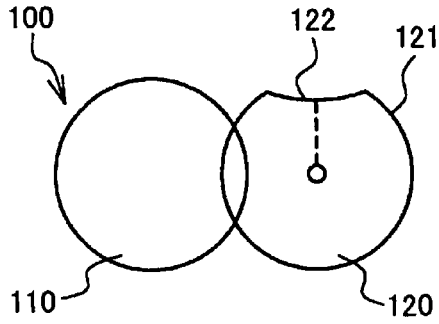
PRIOR ART FIG.15B

FIG. 14 is a flowchart of operation procedures according to the present embodiment, for managing the contacting time when the main power is turned off.

These operation procedures start when the main power has been turned off in one of the steps of the flowchart (FIG. 6) of the stop control operation for the fixing roller.

In the flow of FIG. 14, first, the control system detects the temperature of the fixing part, and the detected temperature is stored and managed by the storage unit 29 (step S601). This operation of detecting the temperature is performed every second as long as the main power is turned on (No in step S602), and the time of detection is also stored in the storage unit 29.

When the main power is turned off (Yes in step S602), the control operation of the main control unit 28 is stopped, including the temperature detecting operation.

When the main power is turned on once again (step S603), the control system obtains the main power off time, based on the time when the main power was turned off stored in step S601 immediately before the main power was turned off, and the time when the main power was turned on once again (step S604).

Furthermore, the control system reads the temperature of the fixing part detected and stored in step S601 immediately before the main power was turned off. Based on this temperature of the fixing part and the main power off time obtained in step S604, the entire contacting time during which the main power is turned off is obtained for each temperature segment (step S605). Specifically, when the temperature of the fixing part immediately before the main power is turned off is, for example, 240° C., data (see FIG. 10) expressing the temperature property in which the starting point is 240° C. is used to obtain that the contacting time in the segment of "more than or equal to 200° C." is four minutes, the contacting time in the segment of "more than or equal to 150° C. and less than 200° C." is six minutes, and the contacting time in the segment of "less than 150° C." is (main power off time −10) minutes. There is a condition that the (main power off time −10) minutes in the segment of "less than 150° C." are not negative.

The obtained contacting times for the respective temperature segments are temporarily stored in the storage unit 29.

Next, the control system confirms the region in which the two rollers of the fixing unit 20 have been contacting each other when the main power was turned off, i.e., the control system identifies one of the separate regions on the contacting surface by checking the count number (step S606).

When the contacting region is confirmed, the control system converts the contacting times for the respective temperature segments obtained in step S605 into reference contacting times, thereby making adjustments in consideration of temperature conditions (step S607). This conversion is performed as follows. For example, when the temperature segment of "less than 150° C." is used as a reference, the contacting time of the segment of "more than or equal to 200° C." is multiplied by three times and the contacting time of the segment of "more than or equal to 150° C. and less than 200° C." is multiplied by two times. In the above specific example (see FIG. 10), the contacting time is obtained as follows.

(4 minutes×3)+(6 minutes×2)+(main power off time −10)=24 minutes+(main power off time −10)

The contacting time adjusted in consideration of temperature conditions is accumulated as history of the corresponding one of the separate regions on the contacting surface, and is stored and managed by the storage unit 29.

[Management of Contacting Time when Main Power is Turned Off (4)]

In the [management of contacting time when main power is turned off (2)] and the [management of contacting time when main power is turned off (3)], the temporal change in the temperature differs according to the different temperatures of the fixing part at the time point when the main power is turned off. Therefore, different contacting times are estimated according to the temperatures of the fixing part detected when the main power is turned off, to obtain more accurate information. However, these methods incur increases in the amount of data and processing load, thus reducing the performance in a device that is required to exhibit high precision.

Accordingly, the present embodiment omits the operations of detecting the temperature of the fixing part and managing the time when the main power is turned off. Instead, a uniform time is accumulated as the contacting time when the main power is turned on once again. This method simplifies the operations and mitigates increases in the data and processing load, thereby improving performance.

The present invention is not limited to the specifically disclosed embodiment, and variations and modifications may be made without departing from the scope of the present invention.

The present application is based on Japanese Priority Patent Application No. 2007-233920, filed on Sep. 10, 2007 and Japanese Priority Patent Application No. 2008-070253, filed on Mar. 18, 2008, the entire contents of which are hereby incorporated herein by reference.

What is claimed is:

1. An image forming apparatus comprising:

a fixing unit configured to fix an unfixed image on a recording medium by bringing a first roller and a second roller in pressure-contact with each other;

a contacting region detecting unit configured to detect a contacting region in which the first roller and the second roller are contacting each other, according to rotation of the first roller;

a storing unit configured to store a contacting time in the contacting region detected by the contacting region detecting unit;

a rotation control unit configured to control the rotation of the first roller in such a manner as to change the contacting region in which the first roller and the second roller contact each other, based on the contacting time stored by the storing unit; and an accumulating unit configured to accumulate the contacting time for each contacting region on a peripheral surface of the first roller that is detected by the contacting region detecting unit as the contacting region, wherein the storing unit stores the contacting time that is accumulated for each of the contacting regions, the image forming apparatus further comprising:

a comparing unit configured to make a comparison between the contacting times stored by the storing unit for each of the contacting regions, wherein the rotation control unit controls the rotation of the first roller, based on results of the comparison, in such a manner that the first roller and the second roller contact each other in one of the contacting regions corresponding to the shortest contacting time among the contacting regions.

2. The image forming apparatus according to claim 1, wherein:

the accumulating unit sequentially accumulates the contacting time while the first roller and the second roller are stopped.

3. The image forming apparatus according to claim 2, wherein:

the storing unit sequentially stores the contacting time accumulated for each of the contacting regions; and the comparing unit sequentially makes the comparison between the contacting times stored by the storing unit.

4. An image forming apparatus, comprising:

a fixing unit configured to fix an unfixed image on a recording medium by bringing a first roller and a second roller in pressure-contact with each other;

a contacting region detecting unit configured to detect a contacting region in which the first roller and the second roller are contacting each other, according to rotation of the first roller;

a storing unit configured to store a contacting time in the contacting region detected by the contacting region detecting unit;

a rotation control unit configured to control the rotation of the first roller in such a manner as to change the contacting region in which the first roller and the second roller contact each other, based on the contacting time stored by the storing unit;

a fixing temperature detecting unit configured to detect a temperature of the fixing unit while the first roller and the second roller are stopped; and a contacting time adjusting unit configured to weight the contacting time stored by the storing unit in the event that the temperature detected by the fixing temperature detecting unit is more than or equal to a predetermined value.

5. The image forming apparatus according to claim 4, wherein:

as the temperature detected by the fixing temperature detecting unit becomes higher, the contacting time adjusting unit will weight the contacting time by a larger weight.

6. The image forming apparatus according to claim 4, further comprising:

a managing unit configured to manage the contacting time, wherein:

in the event that a contacting time T1 adjusted by the contacting time adjusting unit is less than or equal to a contacting time T2 that is not adjusted, the contacting time T1 is stored by the storing unit as the contacting time; and in the event that the contacting time T1 adjusted by the contacting time adjusting unit exceeds the contacting time T2 that is not adjusted, the contacting time T2 is stored by the storing unit as the contacting time.

7. An image forming apparatus, comprising:

a fixing unit configured to fix an unfixed image on a recording medium by bringing a first roller and a second roller in pressure-contact with each other;

a contacting region detecting unit configured to detect a contacting region in which the first roller and the second roller are contacting each other, according to rotation of the first roller;

a storing unit configured to store a contacting time in the contacting region detected by the contacting region detecting unit;

a rotation control unit configured to control the rotation of the first roller in such a manner as to change the contacting region in which the first roller and the second roller contact each other, based on the contacting time stored by the storing unit;

a fixing temperature detecting unit configured to detect a temperature of the fixing unit while the first roller and the second roller are stopped; and a contacting time adjusting unit configured to adjust the contacting time stored by the storing unit, by calculating, based on the temperature detected by the fixing temperature detecting unit, a time until the temperature becomes less than or equal to a predetermined value.

8. The image forming apparatus according to claim 7, further comprising:

an atmospheric temperature detecting unit configured to detect an atmospheric temperature, wherein:

the contacting time adjusting unit changes a method of calculating the time until the temperature of the fixing unit becomes less than or equal to the predetermined value, in accordance with the atmospheric temperature detected by the atmospheric temperature detecting unit.

9. An image forming method, comprising:

fixing an unfixed image on a recording medium by bringing a first roller and a second roller in pressure-contact with each other;

detecting a contacting region in which the first roller and the second roller are contacting each other, according to rotation of the first roller;

storing a contacting time in the detected contacting region;

controlling the rotation of the first roller in such a manner as to change the contacting region in which the first roller and the second roller contact each other, based on the stored contacting time;

accumulating the contacting time for each detected contacting region on a peripheral surface of the first roller as the contacting region;

storing the contacting time that is accumulated for each of the contacting regions;

making a comparison between the stored contacting times for each of the contacting regions; and controlling the rotation of the first roller, based on results of the comparison, in such a manner that the first roller and the second roller contact each other in one of the contacting regions corresponding to the shortest contacting time among the contacting regions.

10. The image forming method according to claim 9, further comprising sequentially accumulating the contacting time while the first roller and the second roller are stopped.

11. The image forming method according to claim 10, further comprising:

sequentially storing the contacting time accumulated for each of the contacting regions; and sequentially making the comparison between the stored contacting times.

12. An image forming method, comprising:

fixing an unfixed image on a recording medium by bringing a first roller and a second roller in pressure-contact with each other;

detecting a contacting region in which the first roller and the second roller are contacting each other, according to rotation of the first roller;

storing a contacting time in the detected contacting region;

controlling the rotation of the first roller in such a manner as to change the contacting region in which the first roller and the second roller contact each other, based on the stored contacting time;

detecting a temperature while the first roller and the second roller are stopped; and weighting the stored contacting time in the event that the temperature is more than or equal to a predetermined value.

13. The image forming method according to claim 12, further comprising weighting the contacting time by a larger weight as the temperature becomes higher.

14. The image forming method according to claim 12, further comprising:

managing the contacting time;

storing a contacting time T1 as the contacting time in the event that the contacting time T1 that has been adjusted is less than or equal to a contacting time T2 that has not been adjusted; and storing the contacting time T2 as the contacting time in the event that the contacting time T1 that has been adjusted exceeds the contacting time T2 that has not been adjusted.

15. An image forming method, comprising:

fixing an unfixed image on a recording medium by bringing a first roller and a second roller in pressure-contact with each other;

detecting a contacting region in which the first roller and the second roller are contacting each other, according to rotation of the first roller;

storing a contacting time in the detected contacting region;

controlling the rotation of the first roller in such a manner as to change the contacting region in which the first roller and the second roller contact each other, based on the stored contacting time;

detecting a temperature while the first roller and the second roller are stopped; and adjusting the stored contacting time, by calculating, based on the detected temperature, a time until the temperature becomes less than or equal to a predetermined value.

16. The image forming method according to claim 15, further comprising:

detecting an atmospheric temperature; and changing a method of calculating the time until the temperature becomes less than or equal to the predetermined value, in accordance with the detected atmospheric temperature.

* * * * *